US010104931B1

(12) United States Patent
Krastev

(10) Patent No.: US 10,104,931 B1
(45) Date of Patent: Oct. 23, 2018

(54) ALTERNATIVE STRAP CONFIGURATIONS FOR SANDALS AND FLIP FLOPS, AND METHODS OF MANUFACTURING SAME

(71) Applicant: Pavel Krastev, New Hyde Park, NY (US)

(72) Inventor: Pavel Krastev, New Hyde Park, NY (US)

( * ) Notice: Subject to any disclaimer, the term of this patent is extended or adjusted under 35 U.S.C. 154(b) by 43 days.

(21) Appl. No.: 15/267,190

(22) Filed: Sep. 16, 2016

Related U.S. Application Data

(60) Provisional application No. 62/251,204, filed on Nov. 5, 2015, provisional application No. 62/220,323, filed on Sep. 18, 2015.

(51) Int. Cl.

| | |
|---|---|
| ***A43B 3/12*** | (2006.01) |
| ***A43B 3/24*** | (2006.01) |
| ***A43B 1/00*** | (2006.01) |
| ***A43B 13/02*** | (2006.01) |
| ***A43B 23/24*** | (2006.01) |
| ***A43B 3/10*** | (2006.01) |
| ***A43B 3/00*** | (2006.01) |

(52) U.S. Cl.
CPC ..... *A43B 3/24* (2013.01); *A43B 1/0036* (2013.01); *A43B 3/0078* (2013.01); *A43B 3/10* (2013.01); *A43B 3/103* (2013.01); *A43B 3/105* (2013.01); *A43B 3/122* (2013.01); *A43B 3/126* (2013.01); *A43B 3/128* (2013.01); *A43B 13/02* (2013.01); *A43B 23/24* (2013.01)

(58) Field of Classification Search
CPC ..... A43B 1/0036; A43B 3/10; A43B 3/103; A43B 3/105; A43B 3/126; A43B 3/122; A43B 3/128; A43B 3/0078; A43B 23/24
USPC ..... 36/11.5
See application file for complete search history.

(56) References Cited

U.S. PATENT DOCUMENTS

| | | | | |
|---|---|---|---|---|
| 5,716,723 | A * | 2/1998 | Van Cleef | A43B 1/0036 36/25 R |
| 2005/0016032 | A1* | 1/2005 | Cox | A43B 1/0027 36/136 |
| 2006/0213080 | A1* | 9/2006 | Sussman | A43B 3/0078 36/12 |
| 2008/0060227 | A1* | 3/2008 | Enderson | A43B 3/103 36/100 |
| 2010/0003472 | A1* | 1/2010 | Lien | A43B 1/0036 428/195.1 |

(Continued)

*Primary Examiner* — Ted Kavanaugh
(74) *Attorney, Agent, or Firm* — Thomas A. O'Rourke; Bodner & O'Rourke, LLP

(57) ABSTRACT

A flip-flop sandal includes a colored sole, and first and second straps that transition laterally away from a thong secured to the front of the sole. Rubber bands of different colors, thicknesses, outer diameters, and/or textures are received over the stop members at the distal ends of the straps, and onto the straps to customize its appearance. A special tool may be releasably coupled to the stop member and be used to easily slide the rubber bands over the stop members. The straps may have recesses transverse to its length, formed about an entire periphery of the strap, with rubber hands each configured to fit within one of the recesses. The rubber bands, straps, and/or portions of the sole may be formed of a material configured to absorb photons when present, and thereafter glow the various different colors when in the dark. Alternative manufacturing methods for flip flops is also provided.

9 Claims, 25 Drawing Sheets

(56) References Cited

U.S. PATENT DOCUMENTS

| | | | | |
|---|---|---|---|---|
| 2010/0058619 | A1* | 3/2010 | Ferrante | A43B 3/126<br>36/136 |
| 2011/0239484 | A1* | 10/2011 | Giovannetti | A43B 3/103<br>36/11.5 |
| 2012/0186109 | A1* | 7/2012 | Vanderbeek | A43B 3/0078<br>36/136 |
| 2012/0240624 | A1* | 9/2012 | Van Dyne | A41D 27/08<br>63/33 |
| 2013/0091732 | A1* | 4/2013 | Mendoza | A43B 3/0078<br>36/100 |
| 2014/0041167 | A1* | 2/2014 | Simmons | A43C 7/00<br>24/713 |
| 2014/0259772 | A1* | 9/2014 | Hazarian | A43B 3/105<br>36/94 |
| 2017/0258174 | A1* | 9/2017 | Williams | A43B 3/24 |

* cited by examiner

FIG. 1A
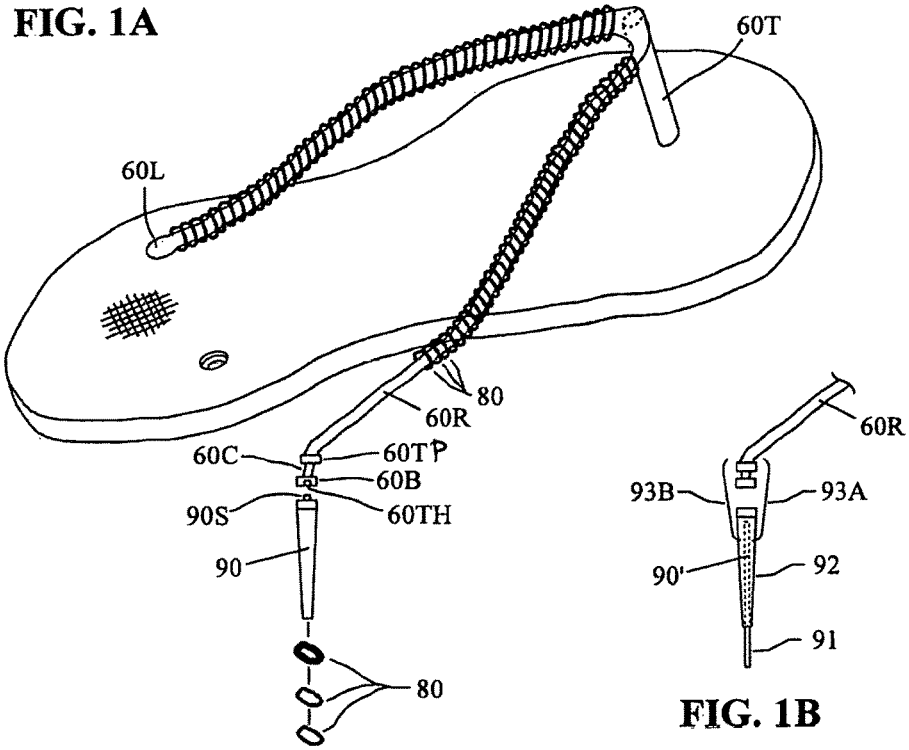
FIG. 1B
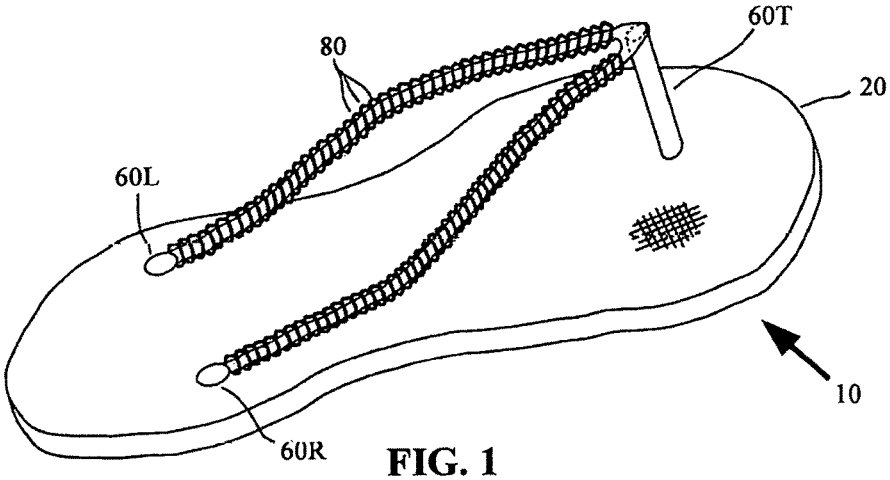
FIG. 1

FIG. 2B
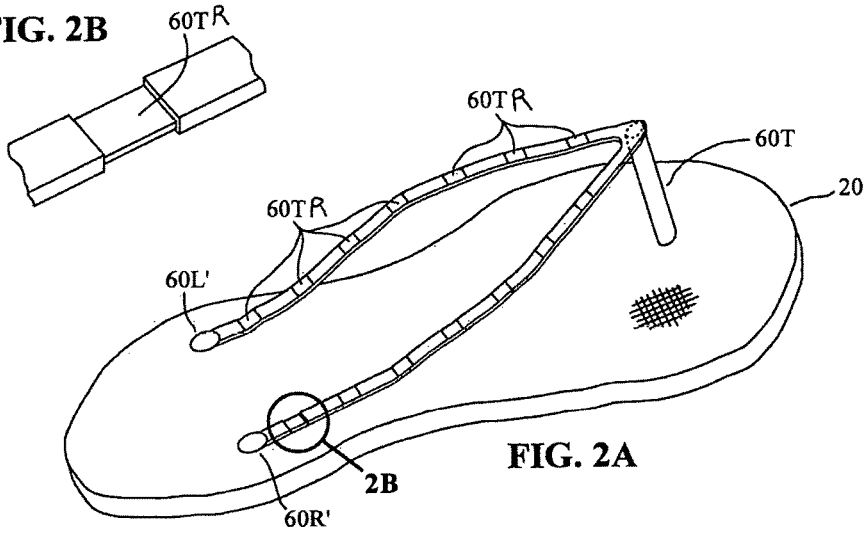
FIG. 2A
FIG. 2D
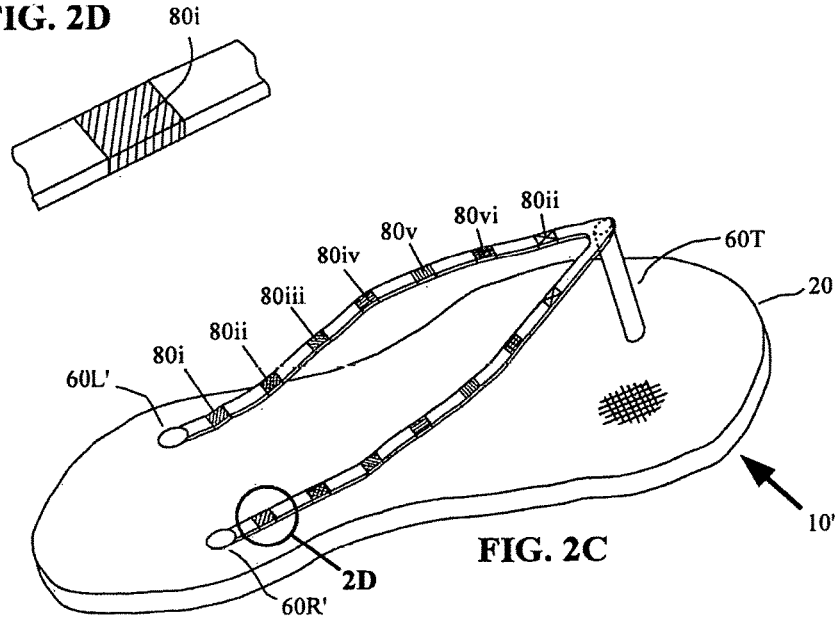
FIG. 2C

FIG. 3
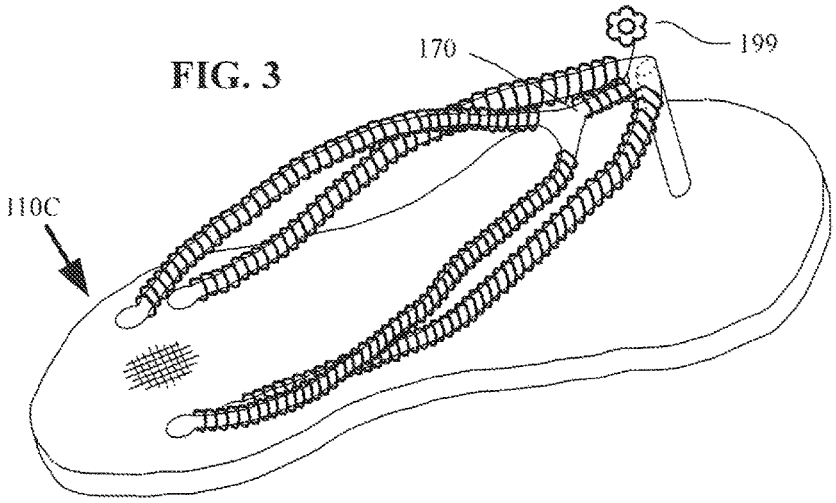
FIG. 3A
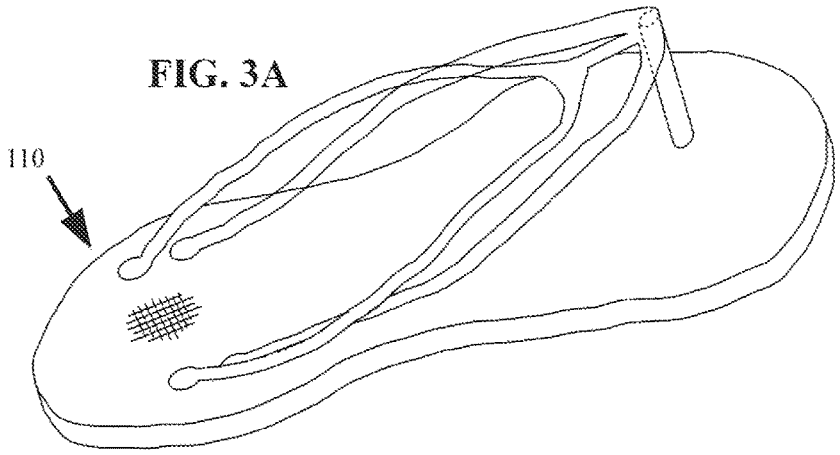
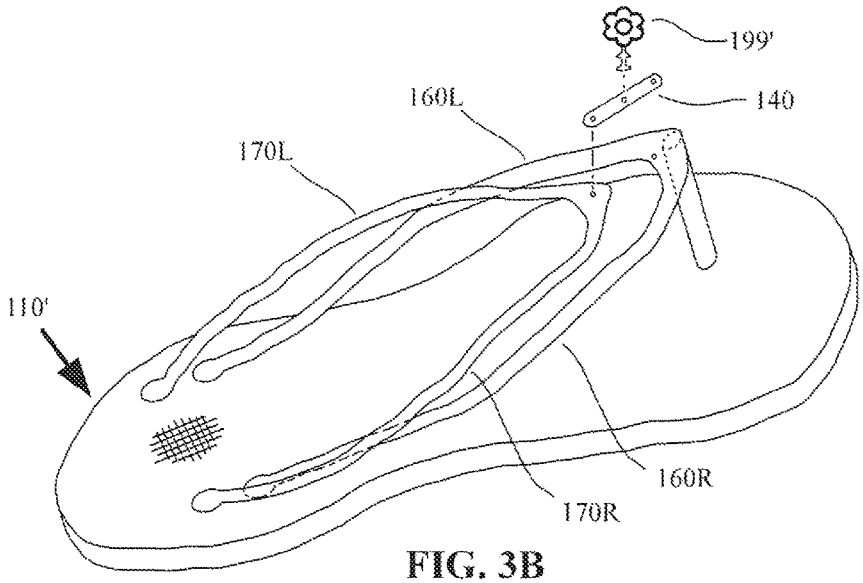
FIG. 3B

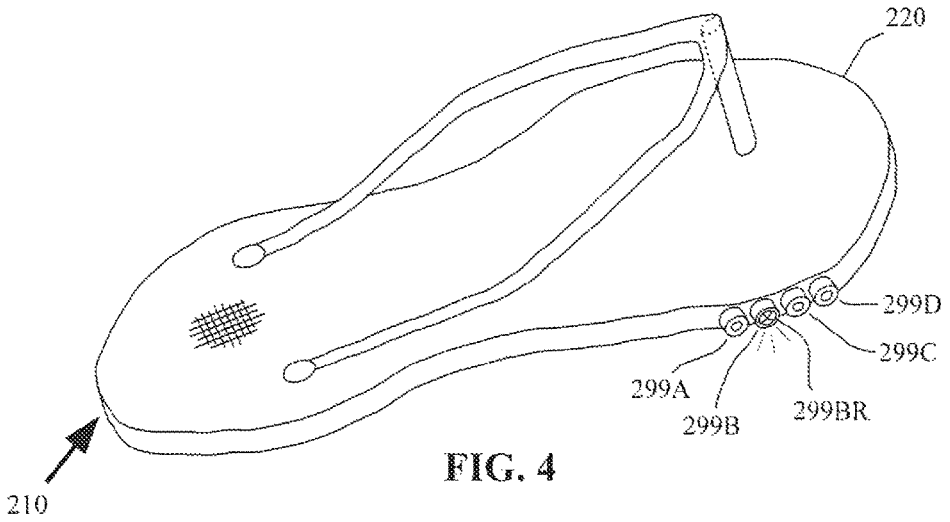
FIG. 4
FIG. 4B
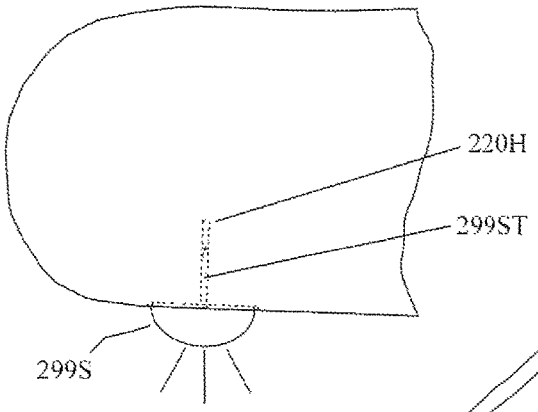
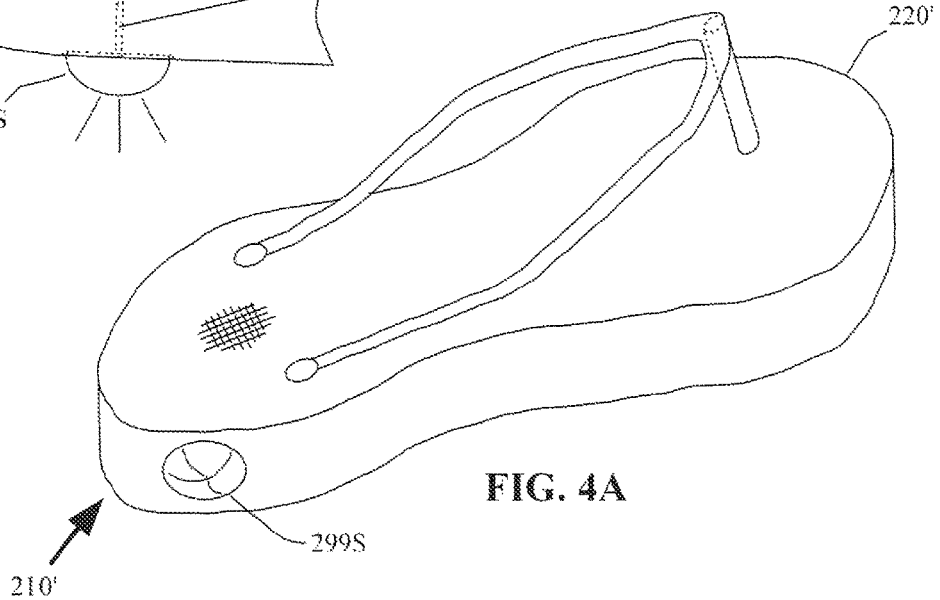
FIG. 4A

FIG. 11
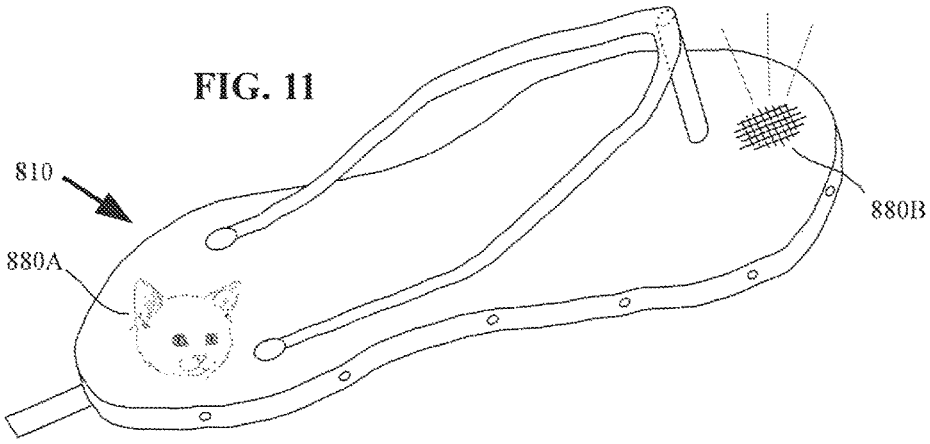
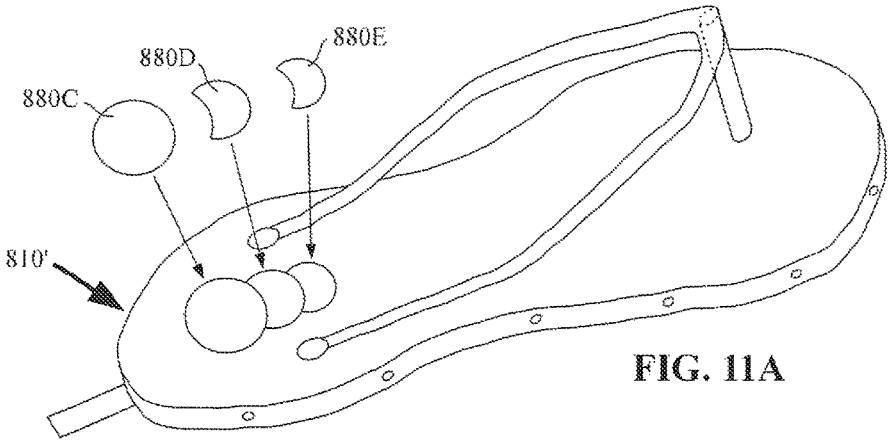
FIG. 11A
FIG. 12
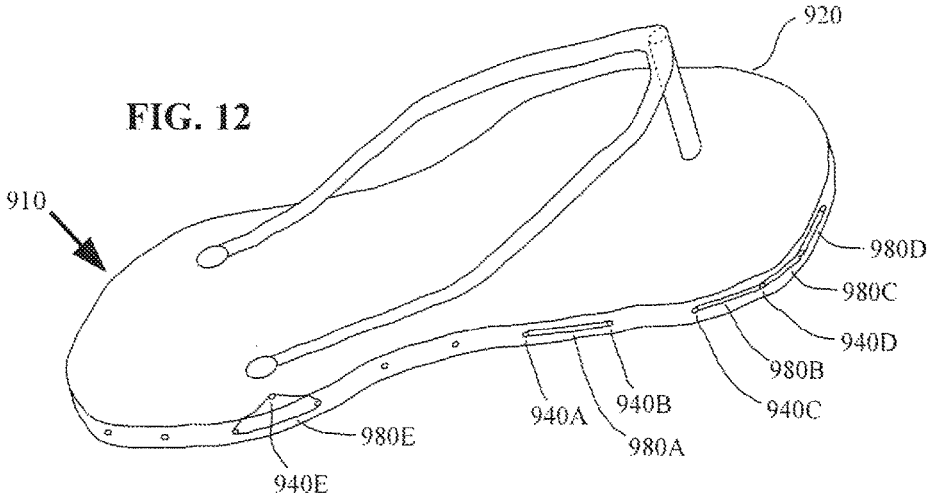

FIG. 14
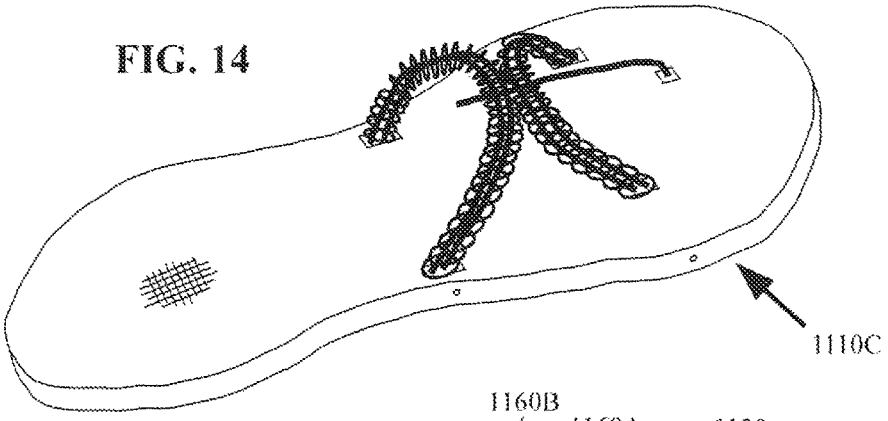
FIG. 14A
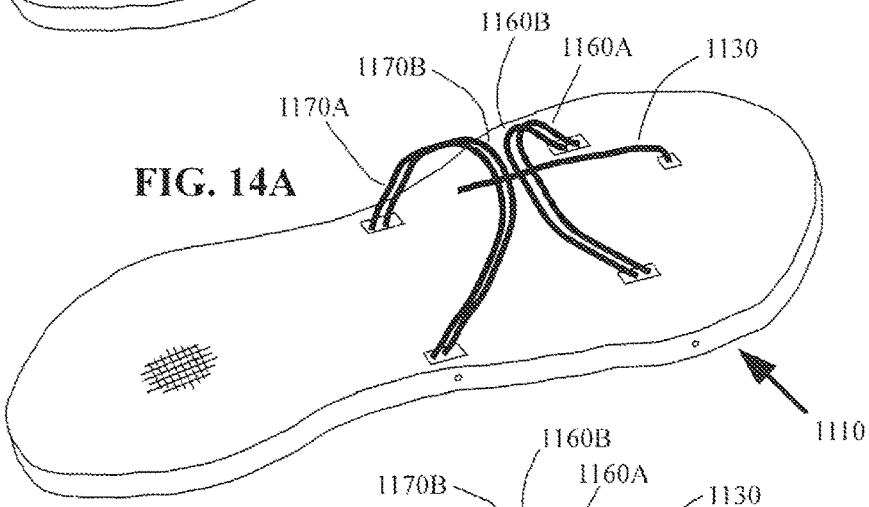
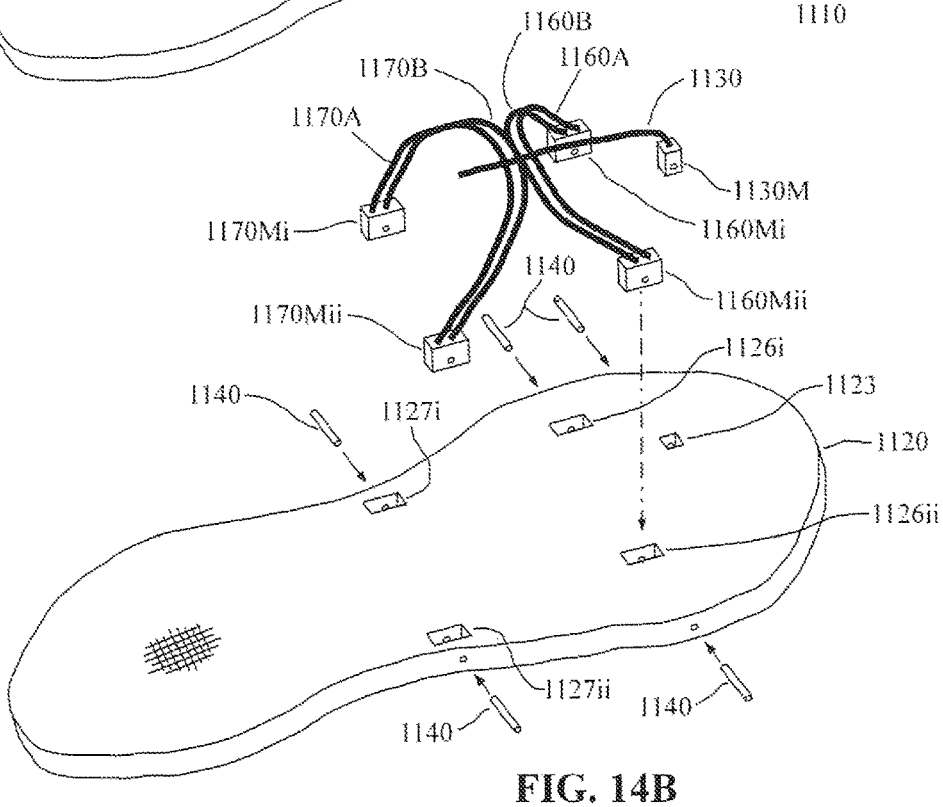
FIG. 14B

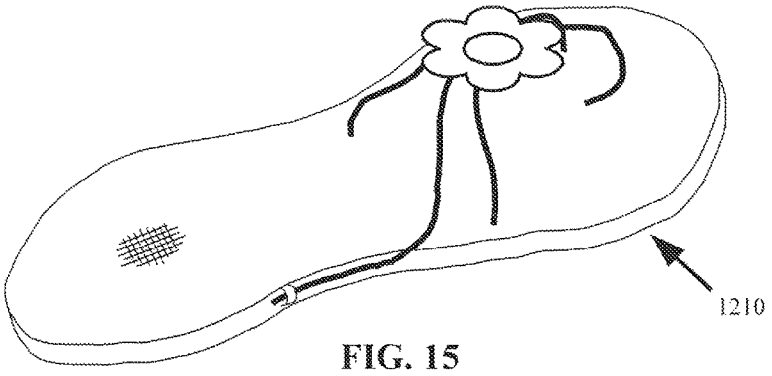
FIG. 15
FIG. 15A
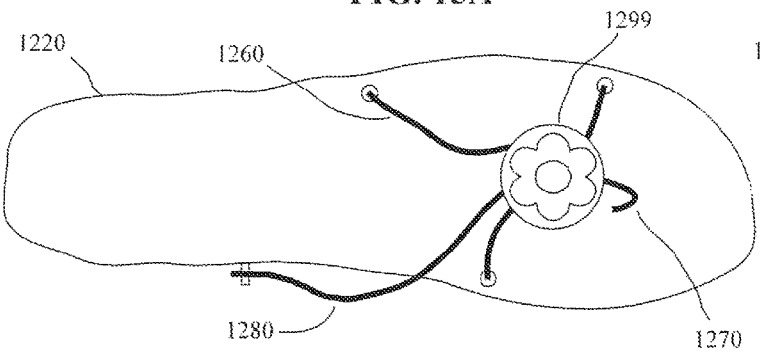
FIG. 15B
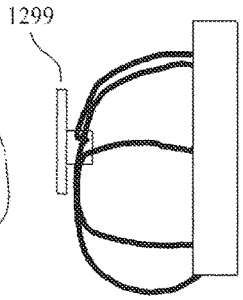
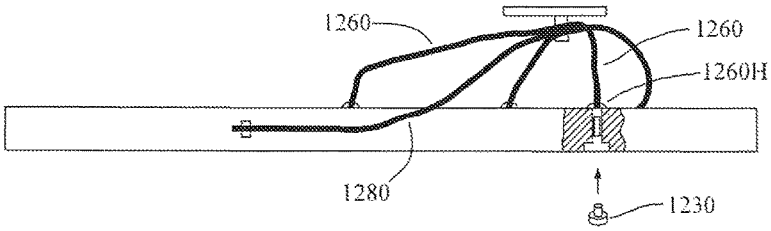
FIG. 15C

FIG. 15D
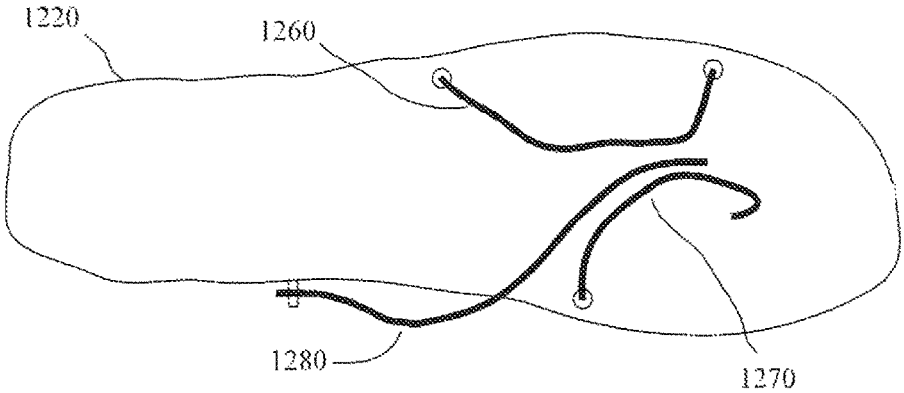
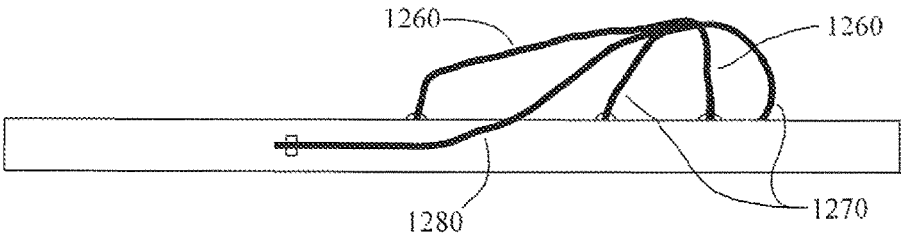
FIG. 15E

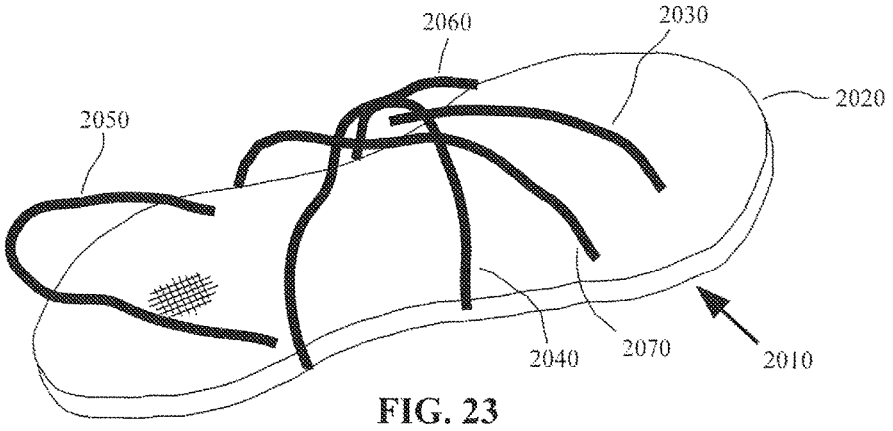
FIG. 23
FIG. 23A
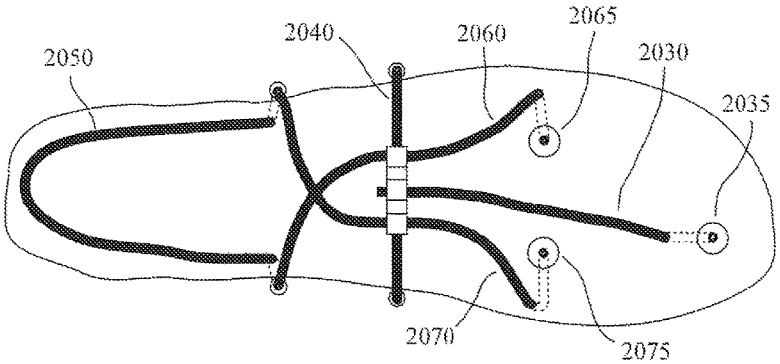
FIG. 23B
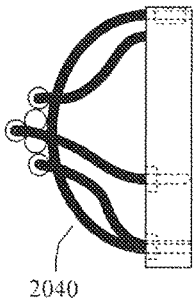
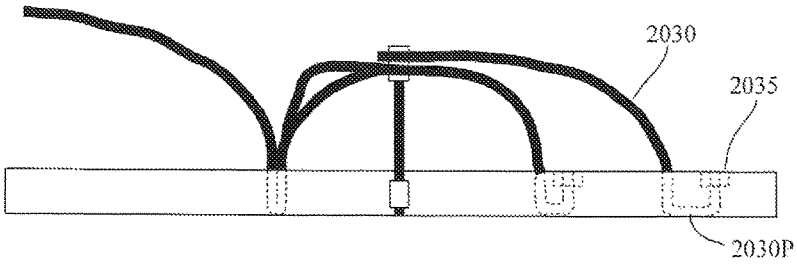
FIG. 23C

ALTERNATIVE STRAP CONFIGURATIONS FOR SANDALS AND FLIP FLOPS, AND METHODS OF MANUFACTURING SAME

CROSS REFERENCES TO RELATED APPLICATIONS

This application is a continuation-in-part of U.S. patent application Ser. No. 15/267,201, filed Sep. 15, 2016, and also claims priority on U.S. Provisional Application Ser. No. 62/251,204, filed on Nov. 5, 2015, and on U.S. Provisional Application Ser. No. 62/220,123, filed on Sep. 18, 2015, all disclosures of which are incorporated herein by reference.

FIELD OF THE INVENTION

The present invention relates to improvements in footwear, and more particularly to improved sandal straps and flip flop straps, and a method of making the same.

BACKGROUND OF THE INVENTION

For many people, particularly for women, it is often more important that the person's footwear be in accordance with personal taste, and that it be coordinated with other garments worn and accessories being carried, than for it to be very comfortable. With sandals or "flip-flops," it is generally accepted by large numbers of people that such footwear can be quite uncomfortable, which is shown by the many blogs that are returned by an internet search of that issue (see e.g., commentary an "Yahoo! Answers" for the subject "Do flip flops always hurt?").

The typical pair of flip flops consist of a generally flat sole, to which is connected a pair of straps or an integrated strap arrangement. One end of each of the straps is respectively connected to the sole, proximate to each side of the heel region. The other end of the straps may be interconnected, and may furthermore coupled to the sole near its front, using a post, or what is more commonly referred to as a "thong." The straps are thus configured to loop over the top of the wearer's foot, while the thong is configured to be received between the wearer's big toe and second toe, with the sole being shaped to provide support for the entirety of the platform provided for the wearer's foot. These flip flops are not only worn at the beach to thereat be quickly removed to enjoy the sand and water, but are also often worn in a public shower, and at casual outings, at restaurants, etc. Sandals are similarly constructed, but may also include an additional strap at the rear of the sole which may be secured about the wearer's ankle. Those two terms—"sandals" and "flip flops" are used interchangeably herein, with that distinction specifically pointed out where necessary.

There have been a number of prior art inventions that have sought to provide interchangeability and different methods of manufacturing with respect to portions of a sandal, which may economically leverage the use of a single pair of footwear. For example, U.S. Pat. No. 3,011,281 to King teaches providing different decorative facings which may attach onto the straps using snaps, so that it may be worn on various different occasions to appear differently. U.S. Pat. No. 6,769,204 to Phillips similarly teaches attachment of a decorative "ribbon" using Velcro.

The present invention teaches decorative and comfort enhancing strap systems and corresponding methods of construction.

OBJECTS OF THE INVENTION

It is an object of the invention to provide a flip flop configuration, the assembly of which may provide an appearance that may be decoratively customized.

It is another object of the invention to provide a flip flop design that permits design customization of the straps and/or the thong of the footwear.

It is a further object of the invention to provide a flip flop design that permits customization of the straps while increasing comfort with respect to its contact with the top of a wearer's foot.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A customized flip flop may broadly include a colored sole, and first and second straps that transition laterally away from a thong secured to the front of the sole. The ends of each of the straps distal from the thong, and the end of the thong itself, may each include a first cylindrical stop member, a protrusion configured to extend therefrom, and a second cylindrical stop member at the distal end of each protrusion. A plurality of rubber bands may be received over the first and second cylindrical stop members and onto each of the first and second strap portions. Rubber bands may also be received over the first and second cylindrical stop members and onto the thong portion. A special tool may be releasably coupled, e.g., threaded, to each of the stop member, one at a time, and may be used to easily slide the rubber bands over the stop members.

Rubber bands of different colors, thicknesses, outer diameters, and/or textures may be used to customize the appearance of the flip flop. The rubber bands, the straps, and/or portions of the sole (e.g., an outer periphery of the sole) may be formed of a material configured to absorb photons when present, and thereafter may glow the various different colors when in the dark. The photoluminescent property may be phosphorescence, as the parts of the flip flop so formed may glow for an extended period of time after dark.

In an alternate embodiment, the straps may have recesses formed transverse to its length, being formed about an entire 360 degree periphery of the strap, where the rubber bands are each configured to fit within one of the recesses to be flush with the strap.

Thereafter, the stop-members of each of the strap portions and the thong portion may be secured to the sole using openings therein.

In another embodiment, a customized flip flop may broadly include a sole, a thong portion and a strap portion. The thong portion may have a first end and a second end, with the first end of the strap secured to a top of a block member. The strap portion may have a toe strap with a first end and a second end, each end being respectively secured to a top of a second block member and a third block member. A portion of the throng strap proximate to its second end may be secured to a central portion of the toe strap. The top of the sole may include a first block-shaped recess, a second block-shaped recess, and a third block-shaped recess, each shaped to respectively correspond to the first, second, and third block members of the thong and toe straps. Also, first, second, and third transverse holes may be formed at a selective location at a peripheral surface of the sole, to respectively transect the first block-shaped recess, the second block-shaped recess, and the third block-shaped. A plurality of rubber bands may be received over the block members, with a first portion of the plurality of rubber hands received over the first block member onto the thong strap, and with a second portion of the plurality of rubber bands received over the second block member onto the toe strap. A first pin, a second pin, and a third pin may be respectively secured in the first, second, and third, transverse holes in the sole and in the transverse holes in the first, second, and third block members, to secure the block members, and thus the straps, to the sole.

Other flip flop and sandal designs, features, and methods of manufacture are also disclosed hereinafter.

BRIEF DESCRIPTION OF THE DRAWINGS

The description of the various exemplary embodiments is explained in conjunction with appended drawings, in which:

FIG. 1 is a flip flop constructed in accordance with a first embodiment of the present invention, shown with rubber bands having been applied to each of the straps, for improved comfort, and customization.

FIG. 1A is a perspective view illustrating a tool that may be utilized for easy application of rubber bands onto the straps of the flip flop embodiment of FIG. 1.

FIG. 1B shows an alternative tool embodiment for use in applying rubber bands onto the straps of the flip flops.

FIG. 2A shows the flip flop of FIG. 2, but with an alternative strap embodiment, where each of the straps is formed with a series of transverse recesses along its length.

FIG. 2B is an enlarged detail view of one of the recesses of the alternative strap of the flip flop embodiment of FIG. 2A.

FIG. 2C is the flip flop of FIG. 2A, but is shown with specially sized rubber bands of different colors and/or textures having been positioned at each of the recesses in the straps.

FIG. 2D is an enlarged detail view showing one of the specially sized rubber bands of different colors and/or textures positioned at one of the recesses of the alternative strap of the flip flop embodiment of FIG. 2A.

FIG. 3 is a perspective view of a customized flip flop with a double strap arrangement, which has been customized with various colors and sizes/thicknesses of rubber bands, in accordance with the teachings herein.

FIG. 3A is the flip flop embodiment of FIG. 3, but with the double strap being utilized without being customized.

FIG. 3B illustrates another double strap flip flop similar to the one shown in FIG. 3, prior to being customized with rubber bands.

FIG. 4 is a perspective view of another flip flop embodiment with the side of the sole being customized with colored rings.

FIG. 4A is a perspective view of an alternate embodiment of the flip flop shown in FIG. 4, in which the side of the sole may be customized with an interchangeable hemispherical glass/plastic ball that may light up or may be photoluminescent.

FIG. 4B is a top view of the flip flop embodiment of FIG. 4A.

FIG. 11 is a perspective view of a flip flop being customized by using a hologram of a cat on the top of the sole, near the ankle support region, and using a photoluminscent material (florescent or phosphorescent) on the top of the sole in the front part of the flip flop.

FIG. 11A is an alternate embodiment of the flip flop of FIG. 11, in which shaped inserts may be received in correspondingly shaped recesses in the sole, each of which may be customized with a hologram thereon, and which may be interchangeable for other customized inserts.

FIG. 12 is a perspective view of another embodiment of a flip flop taught herein, which has either threads or rubber bands looped about spikes that may have a head protruding out from the side of the sole.

FIG. 14 is a perspective view of another embodiment of a flip flop taught herein, which has an elongated thong connected to a forward leaning toe strap, and a rear leaning toe strap, each of which is customized with rubber bands of assorted colors and sizes, and may be releasably secured to a forward portion of the sole of the footwear.

FIG. 14A is a perspective view of the flip flop embodiment of FIG. 14, but shown prior to being customized with rubber bands.

FIG. 14B is an exploded view showing the component parts of the flip flop embodiment of FIG. 14A.

FIG. 15 is a perspective view of another embodiment of a flip flop taught herein, which has tube members configured to form a thong and several toe straps, which support a decorative ornament thereon.

FIG. 15A is a top view of the flip flop embodiment of FIG. 15.

FIG. 15B is an end view of the flip flop embodiment of FIG. 15.

FIG. 15C is a side view of the flip flop embodiment of FIG. 15.

FIG. 15D is the top view of FIG. 15A, but shown without the decorative item mounted to the straps.

FIG. 15E is the side view of FIG. 15C, but shown without the decorative item mounted to the straps.

FIG. 23 is a perspective view of another embodiment of a flip flop taught herein, which has a plurality of straps configured to go over the top of the wearer's foot, and which are uniquely supported by the sole, and may also have an ankle strap.

FIG. 23A is a top view of the flip flop of FIG. 23.

FIG. 23B is an end view of the flip flop of FIG. 23.

FIG. 23C is a side view of the flip flop of FIG. 23.

DETAILED DESCRIPTION OF THE INVENTION

Figure 2:
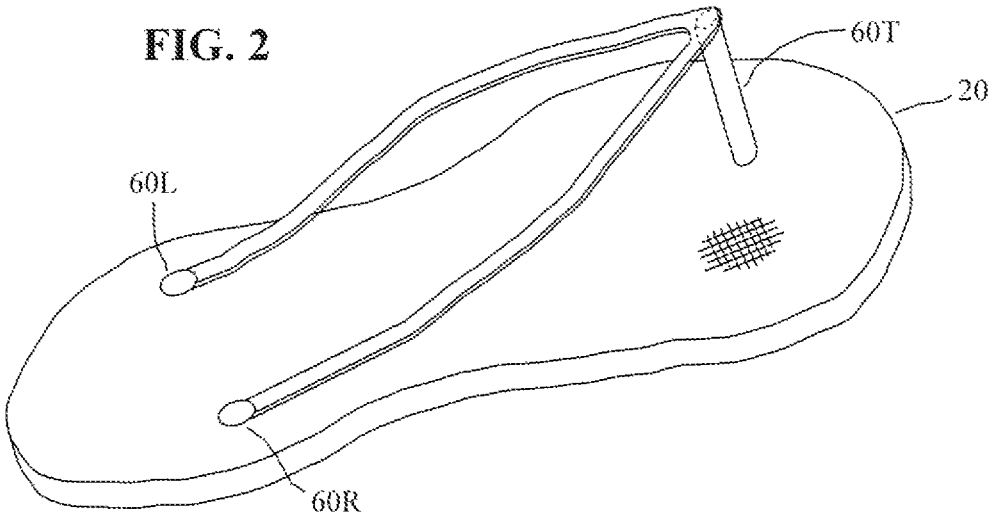
FIG. 2 shows flip flop embodiment of FIG. 1, without any rubber bands having been placed onto the straps.

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B, and/or C" mean all of the following possible combinations: A alone; or B alone; or C alone; or A and B together; or A and C together; or B and C together; or A, B and C together.

Also, all references (e.g., patents, published patent applications, and non-patent literature) that are cited within this documents are incorporated herein in their entirety by reference.

Furthermore, the described features, advantages, and characteristics of any particular embodiment disclosed in the following specification, may be combined in any suitable manner with any of the other embodiments disclosed herein.

FIG. 1 illustrates a perspective view of a flip flop embodiment 10 having a sole 20, and thong 60T that may transition into left-hand and right-hand strap portions (60L and 60R) that have been customized in accordance with the present invention, and which may have a plurality of rubber bands 80 of assorted colors and thicknesses received thereon.

As seen in FIG. 1A, prior to securing of the ends of the left-hand strap portion 60L and the right-hand strap portion 60R to the sole 20, rubber bands 80 may be stretched over those ends to customize the appearance of the straps. The rubber bands may be made of a photoluminescent material (florescent or preferably phosphorescent), which material may absorb photons when present in the environment either from natural daylight or from artificial lighting, and may thereafter glow in the dark. A portion of the strap, e.g., its periphery, may also be made of a photoluminescent material, which may glow the same color as the strap, which may match or may contrast with the colors selected for the rubber bands. The photoluminescent features may serve to highlight the colored nature of the flip flop at night in the dark, and may also provide some light for the safety of the wearer, when walking at very dark, isolated locations.

In one embodiment, the rubber/plastic bands may be adhesively bonded to the underlying strap(s). In addition, a clear top coat may also be applied over the bands once placed on the straps.

If a generous clearance fit is not used for the sizing of the rubber band diameter with respect to the strap, a tool 90 may be used to more easily load the rubber bands 80 over the stop members at the ends of the straps. The ends of each strap portion may have a top stop member 60TP from which may protrude a short cylindrical connector member 60C that may be used to space apart a bottom stop member 60B that may be formed at a distal end of time connector member. In one embodiment, the bottom stop member 60B may have a threaded insert 60TH with internal threads that are configured to receive the corresponding external threads formed on a stud 90S of the tool 90. The tool 90 may thus be threadably engaged with the lower stop member 60L so that the rubber bands may be easily slid onto the strap portion 60R.

An alternative embodiment in the form of tool 90' is shown in FIG. 1B, in which the tool may instead have a spring-biased shaft 91 that may extend in relation to the handle 92, and which, when depressed, may cause a series of radially positioned prongs (e.g., 93A, 93B, . . . ) to rotate outwardly, and which may receive the lower stop member 60L and upper stop member 60U therein. Upon releasing the spring-biased shaft 91, the prongs may rotate inwardly and be enclosed around the top stop member 60TP and bottom stop member 60B so that the rubber bands may be easily slid onto the strap portion 60R.

FIG. 2 shows the straps 60L/60R of the flip flop embodiment of FIG. 1, but without any rubber bands placed thereon. FIG. 2A shows an alternate embodiment of that flip flop, having a strap 60L' and 60R', each of which may have a series of transverse recesses 60TR formed at discrete positions along its length, and being formed about an entire transverse periphery of the strap portion. The recesses 60TR may each be formed in the straps 60L' and 60R' during the injection molding process used to create the straps. One of the recesses is shown enlarged in the detail view of FIG. 2B. As seen in FIG. 2C, specially sized rubber bands of different colors and/or textures (e.g., rubber bands 80*i*, 80*ii*, 80*iii*, 80*iv*, 80*v*, 80*vi*, 80*vii*, etc.), which may be much wider, may be placed at each of the recesses in the straps to form flip flop 10'. The depth of the recess may be sized to roughly correspond to the thickness of the rubber bands when placed upon the perimeter of the recess, so that they may be substantially flush with the outer surface of the straps.

FIGS. 3, 3A, and 3B illustrate a perspective view of flip flop embodiments 110C, 110, and 110', each having a sole 120 with a first pair of strap portions (i.e., left-hand strap portion 160L and right-hand strap portion 160R), and a second pair of strap portions (i.e., left-hand strap portion 170L and right-hand strap portion 170R). Flip flop 110C is the flip flop 100, but has been customized with rubber bands in accordance with the teachings of the present invention. In addition, a tchotchke 199 may be attached to one of the rubber bands for additional decorative effect near the front of the flip flop 110C. The second pair of strap portions 170L and 170R may be integrally formed with the first pair of strap portions 160L and 160R, as shown in FIG. 3A, using a connector 170 that connects to the central portion of the first pair of strap portions to the second pair of strap portions. Alternatively, the first pair of strap portions 160L and 160R and the second pair of strap portions 170L and 170R may be formed separately, and the central portions of each may be coupled together using connector member 170' and mechanical fasteners (e.g., rivets), as seen for the flip flop 110' in FIG. 3B. The flip flop 110' may be similarly customized, and additionally, the connector member 170' may also receive rubber bands thereon. Also, to central hole in the connector member 170' may fixedly receive the post of a tchotchke 199 therein, as shown in FIG. 3A.

FIG. 4 is a perspective view of a flip flop embodiment 210 in which the side of the sole 220 be customized with colored rings (e.g. 299A, 299B, 299C, 299D, etc.), rings which may be secured to a portion of, or all about the periphery of, the sole, rising adhesive, or mechanical fasteners, etc. The colored rings may furthermore receive rhinestones or other faceted/reflective objects therein, as with the rhinestone 299BR shown for the colored ring 299B.

FIGS. 4A-4B show a perspective view and a top view of a flip flop embodiment 210' which is similar to the flop embodiment shown in shown in FIG. 4, as the side of the sole may similarly be customized. The side of the sole may be customized with an interchangeable hemispherical glass/plastic ball 299S that may light up using a light element and/or may be photoluminescent. The hemispherical glass/plastic ball 299S may have a shaft 299ST protruding from its rear side that may terminate in a point, and which may be received into the sole 220. A small preformed hole may be utilized in the sole at periodic locations to accommodate easier insertion of the shaft 299ST within the sole 220.

Figure 5:
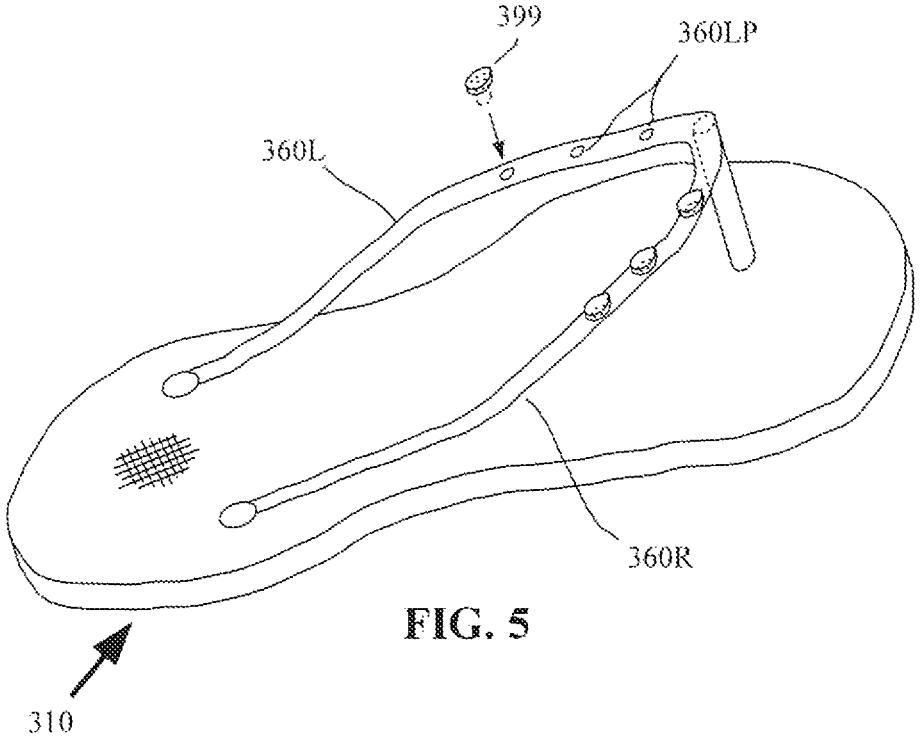
FIG. 5 is a perspective view of another flip flop embodiment with the strap being customized with colored ornaments and other shaped objects being secured to openings therein.

FIG. 5 is a perspective view of a flip flop embodiment 310 in which the left-hand strap portion 360L is shown being customized by attachment of colored rings and/or other shaped objects 399 to openings 360LP therein, using a mechanical fastening arrangement (e.g., using objects that may be bucket thereto like a rivet). The right-hand strap portion 160R is shown therein after having been customized.

Figure 6:
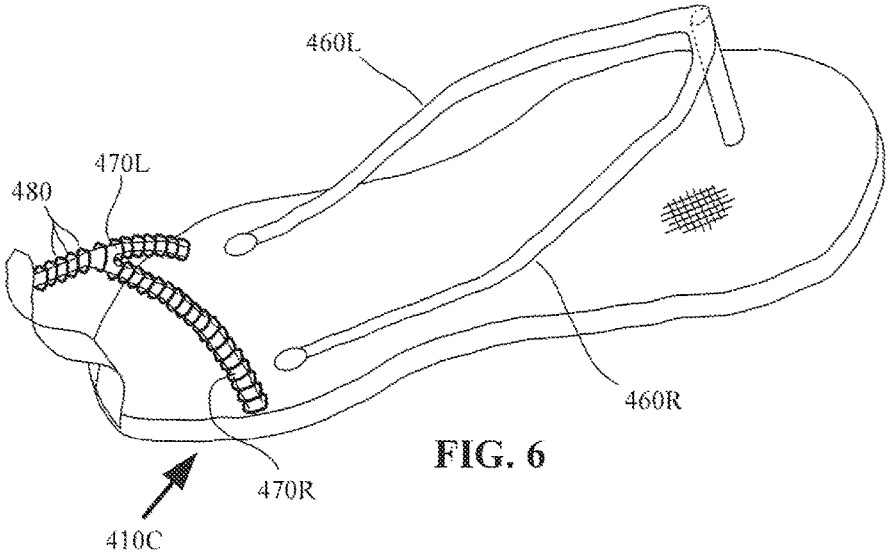
FIG. 6 is a perspective view of a sandal embodiment, where the straps that cross over the top of the foot may be customized with rubber bands, as well as a rear strap that may contact and engage the back of the wearer's foot.
Figure 6A:
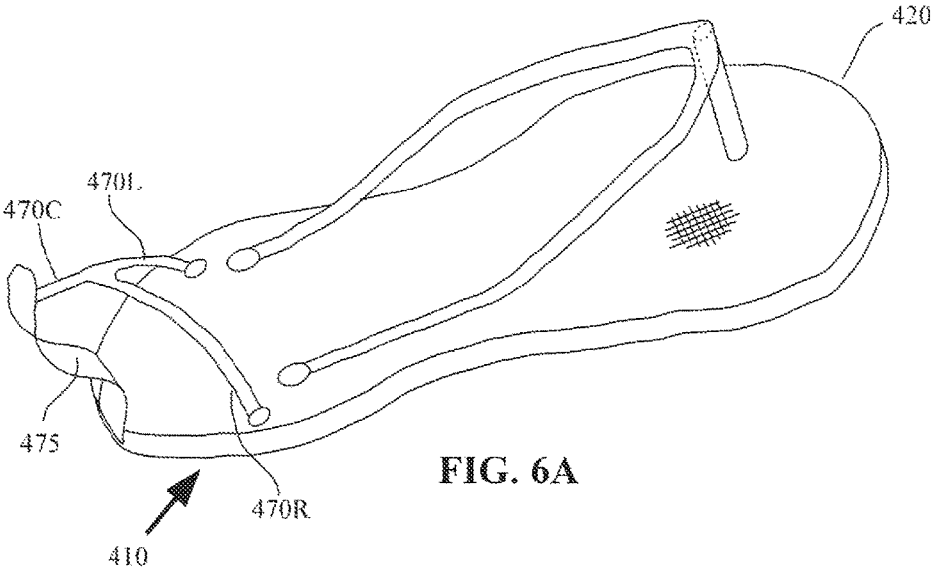
FIG. 6A illustrates the sandal of FIG. 6, prior to being customized with rubber bands.
Figure 7:
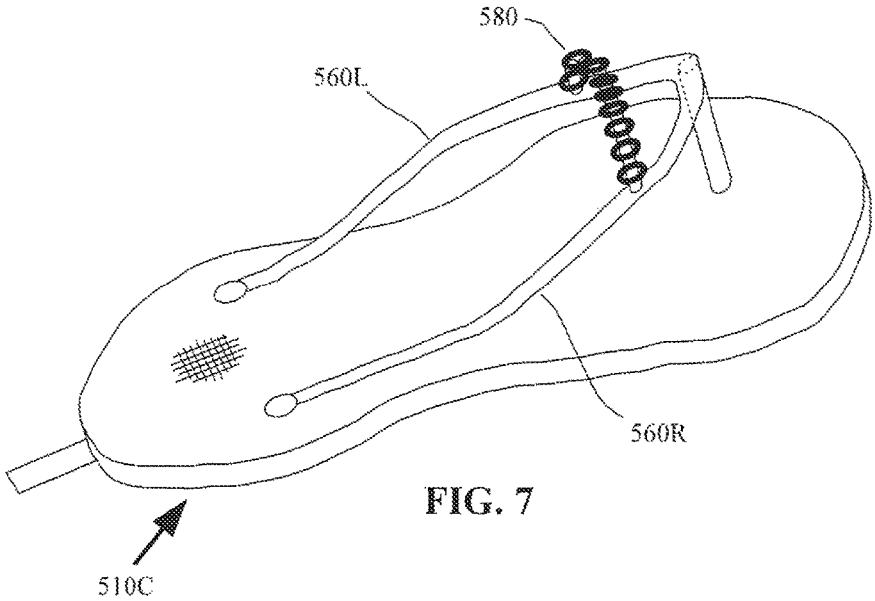
FIG. 7 is a perspective view of another flip flop embodiment having a tube member looping between the top of the left side and the right side of the strap, which tube may be customized with rubber bands of assorted sizes and colors.
Figure 7A:
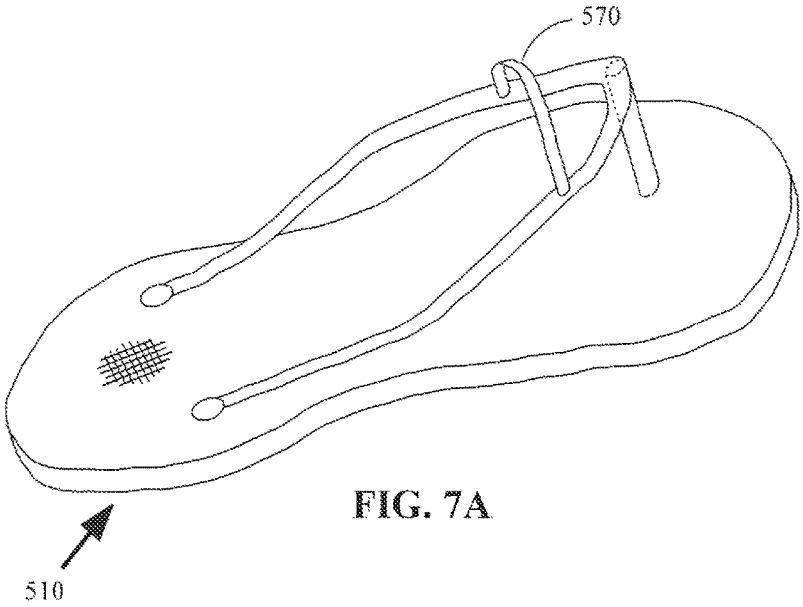
FIG. 7A illustrates the flip flop of FIG. 7, prior to being customized with rubber bands.

FIG. 6 is a perspective view of a customized sandal embodiment 410C, which may be a customized version of the sandal 410 shown in FIG. 6A. Sandal 410 includes a left-hand strap portion 460L and right-hand strap portion 460R that may cross over the top of the foot, and may further include a left-hand strap portion 470L and right-hand strap portion 470R that may be coupled together to engage the back of the wearer's foot. Each of the strap portions may be customized with rubber bands, as described previously. To provide support for the upper end of the left-hand and right-hand strap portions 470L/470R, a connector member 470C may extend rearward therefrom and may be coupled to a curved support member 475 that may extend upwardly from the sole 420. The connector member 470C may also be customized with a plurality of rubber bands 480, FIG. 7 is a perspective view of a customized flip flop embodiment 510C, which may be a customized version of the flip flop 510 shown in FIG. 7A. The flip flop 510 may have a cylindrical member 570 that may have each of its ends respectively secured to the top of the left side strap portion 560L and the right side strap portion 560R. One of the ends may be releasably coupled to the cylindrical member 570 and may thereby be customized on different occasions using rubber bands 580 of different sizes and colors.

Figure 8:
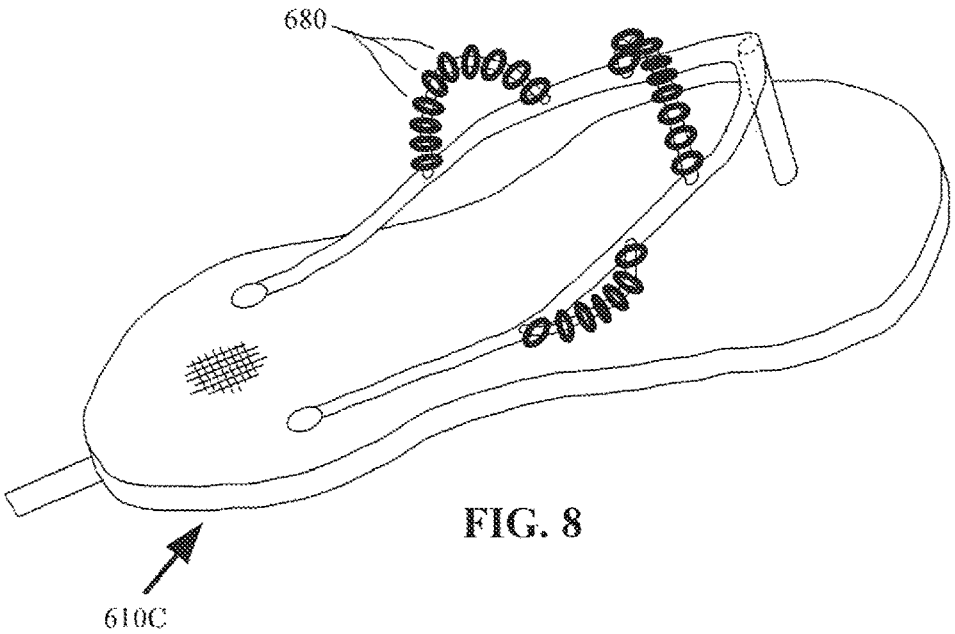
FIG. 8 is the flip flop embodiment of FIG. 7, but which additionally has another tube member looping from one part of the left side strap to another part thereon, as well as a another tube member looping from one part of the left side strap to another part thereon, with those additional tube members also being customized with rubber bands of assorted sizes and colors.
Figure 8A:
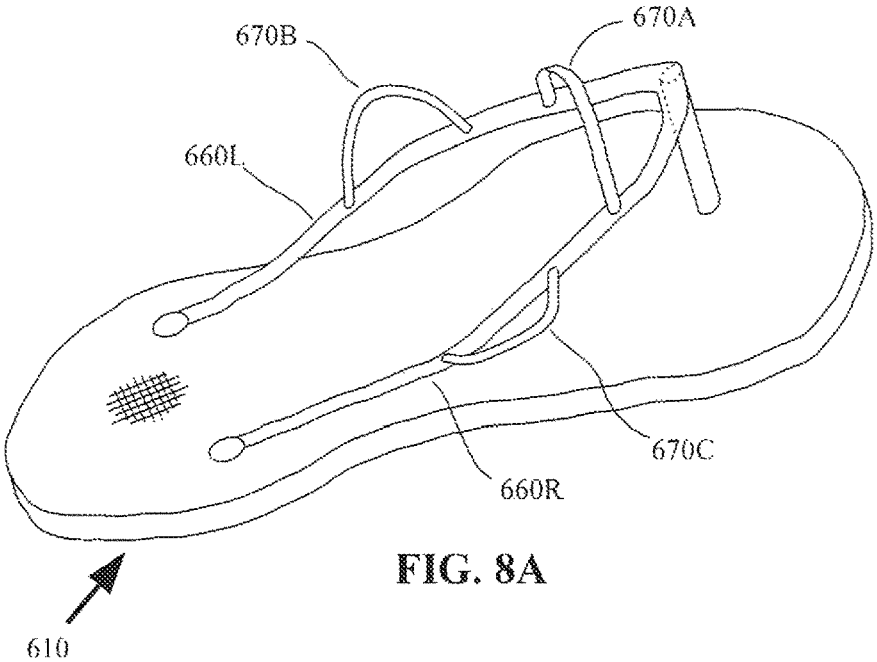
FIG. 8A illustrates the flip flop of FIG. 8, prior to being customized with rubber bands.

FIG. 8 is a perspective view of a customized flip flop embodiment 610C, which may be a customized version of the flip flop 610 shown in FIG. 8A. The flip flop 610 may be formed similar to the flip flop 510 shown in FIG. 7A, having a cylindrical member 670A that may have each of its ends respectively secured to the top of the left side strap portion 660L and the right side strap portion 660R. Additionally, flip flop 610 may have another tube member 670B looping from one part of the left side strap portion 660L to another part thereon, as well as a another tube member 670C looping from one part of the right side strap portion 660R to another part thereon, where those additional tube members may also be customized, with rubber bands 680 of assorted sizes and colors.

Figure 9:
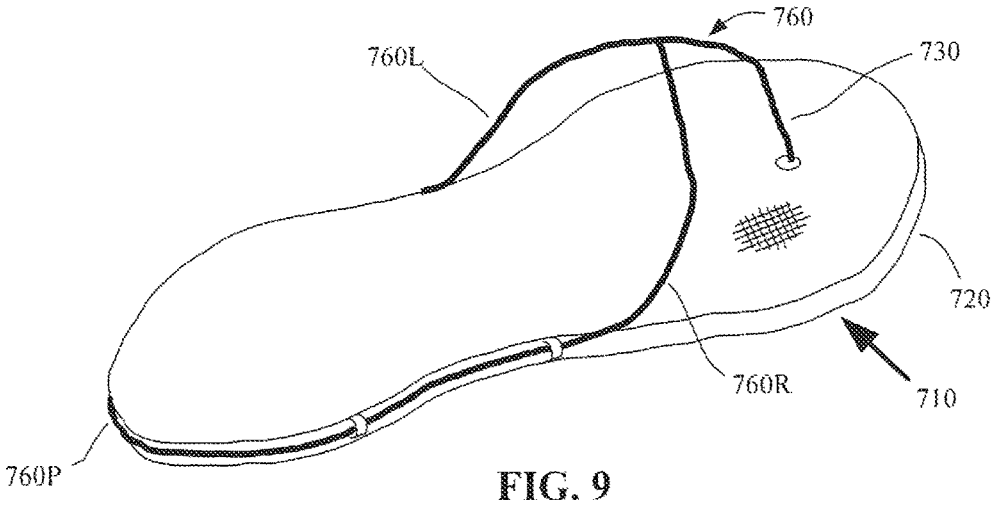
FIG. 9 is a perspective view of another embodiment of a flip flop taught herein, which has the traditional straps replaced by a tube member, where the tube member portion that serves as the thong may be affixed to the sole using a spherical bearing.
Figure 9A:
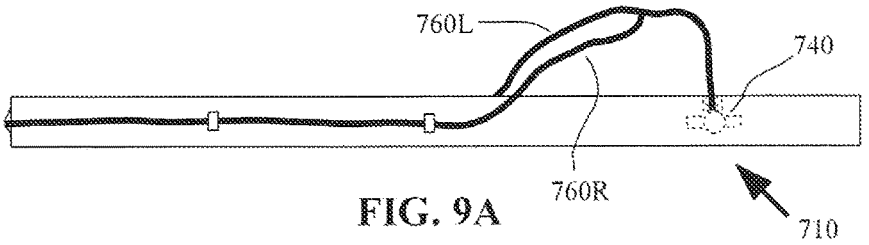
FIG. 9A is side view of the flip flop embodiment of FIG. 9.
Figure 10:
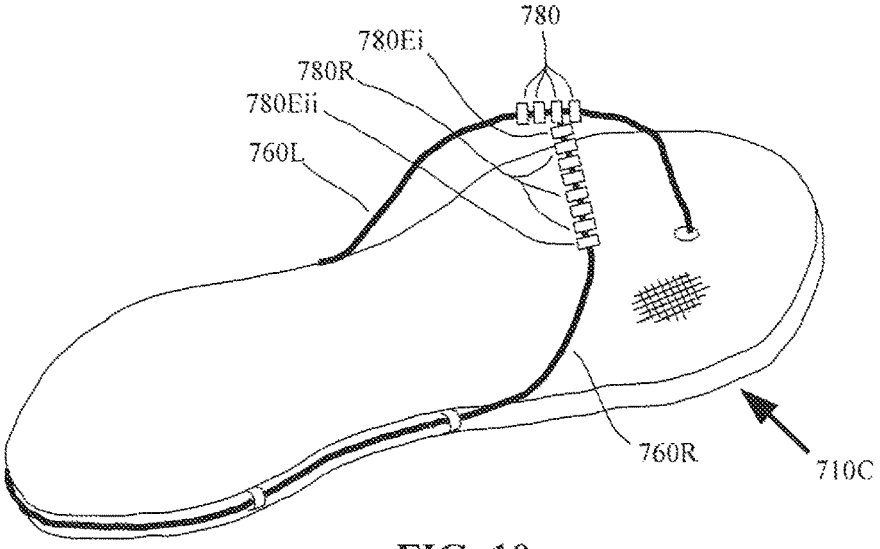
FIG. 10 is a perspective view of the flip flop embodiment of FIG. 9, but shown with each of the tube member portions that would span across the top of the wearer's foot being customized using foam rubber wheels of various colors and thicknesses.

FIG. 9 is a perspective view of a flip flop embodiment 710, which may have the left-hand and right-hand strap portions replaced by a tube member 760. The portion of the tube member 760 that may serve as the thong 730 may be affixed to the sole 720 by being connected to a spherical bearing 740 that may be fixedly secured within the sole, as seen in FIG. 9A. This arrangement may permit more flexible movement of the thong portion 730, which movement may be dictated by the movement of the wearer. The thong portion 730 of the tube member 760 may transition to another portion 760L that may extend over one side of the wearer's foot (e.g., the left side as shown in FIG. 9), and may then angle down to another portion 760P that may be secured about the periphery of the side of the sole 720. The portion 760P may then angle upwardly for another portion 760R to extend over the opposite side of the wearer's foot and be coupled to the portion 760L. Each of the portions 760L and 760R may be customized, as seen for flip flop 710C in FIG. 10, using foam rubber wheels 780, which may be of various colors and thicknesses. The foam rubber wheels 780 may be fixedly secured to the strap portion 760L. For the strap portion 760L, the foam rubber wheels may be fixedly secured thereto, or instead, only the end most foam wheels (i.e., 780Ei and 780Eii) may be fixedly secured to the strap portion 760L, and the other foam wheels 780R may be rotatable thereon. The rotation of the foam rubber wheels between wheels 780Ei and 780Eii may serve to more easily accommodate insertion of the wearer's foot therein.

FIG. 11 is a perspective view of a flip flop embodiment 810, which may be customized by applying a hologram onto a portion of the top surface of the sole (e.g., the cat hologram 880A shown near the ankle support region), or which may be applied to the entirety of the top surface of the sole. The hologram may be applied using a lenticular printing method. The top surface of the sole may also be customized by a applying a photoluminscent material (florescent or phosphorescent) thereon (e.g., the photoluminscent material 880B in the front portion of the sole of the flip flop).

FIG. 11A is a flip flop embodiment 810' in which one or more shaped inserts (e.g., 810C, 810D, 810E, etc.) may be received in one or more correspondingly shaped recesses in the sole, each of which may be customized with a hologram thereon, and which may be interchangeable for other similarly shaped customized inserts. The insert may simply have a circular shape for its periphery (i.e., may be a shallow cylindrical member like 810C), or may instead have a more complex peripheral shape.

FIG. 12 is a perspective view of a flip flop embodiment 810, which may have a plurality of spikes (e.g., 940A, 940B, 940C, 940D, etc.) driven into the side of the sole 920 (or which may be positioned thereat as a result of the sole being injection molded about the spikes). The head and at least a small portion of the shank of the spikes may protrude from the side surface of the sole 920, to permit either threads or rubber bands (e.g., 980A, 980B, 980C, 980D, 980E, etc.) to be looped about the shank and be retained thereon by the bulbous head. In certain locations, the head of one or more spikes (e.g., 940E) may protrude upward from the top surface of the sole 920, to permit the thread or a rubber band (e.g., 980E) to be secure thereat for further customization that may appear on the top of the sole.

Figure 13:
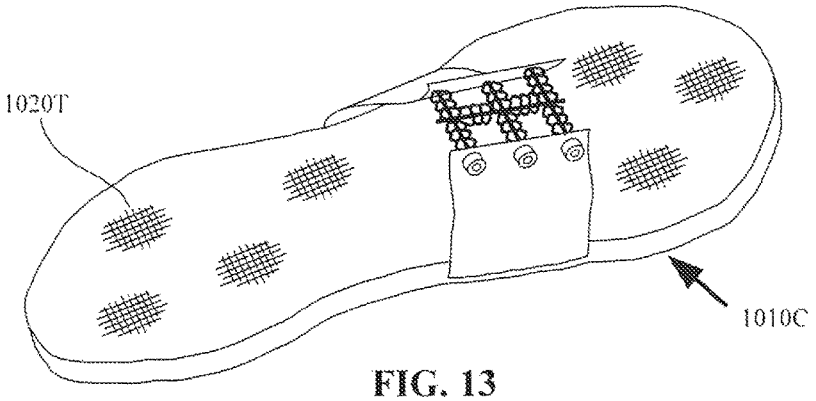
FIG. 13 is a perspective view of another embodiment of a flip flop taught herein, which has a split toe strap that is held together by a plurality of tube members that may have rubber bands positioned thereon to customize the footwear.
Figure 13A:
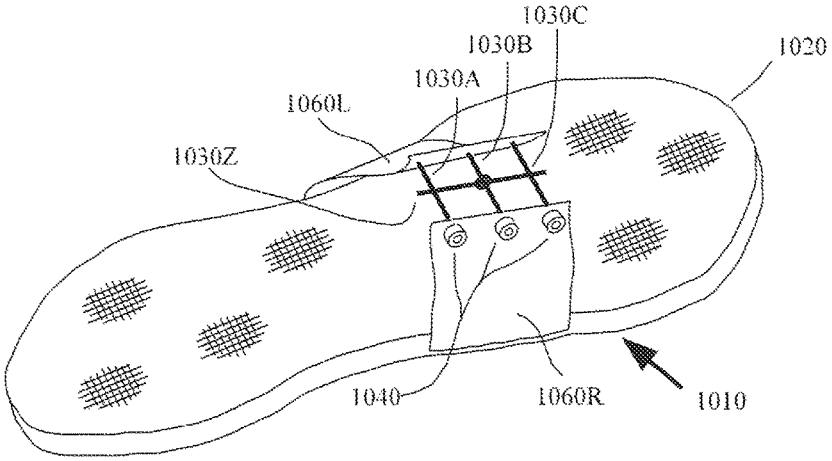
FIG. 13A is a perspective view of the flip flop embodiment of FIG. 13, but shown prior to being customized with rubber bands.
Figure 13B:
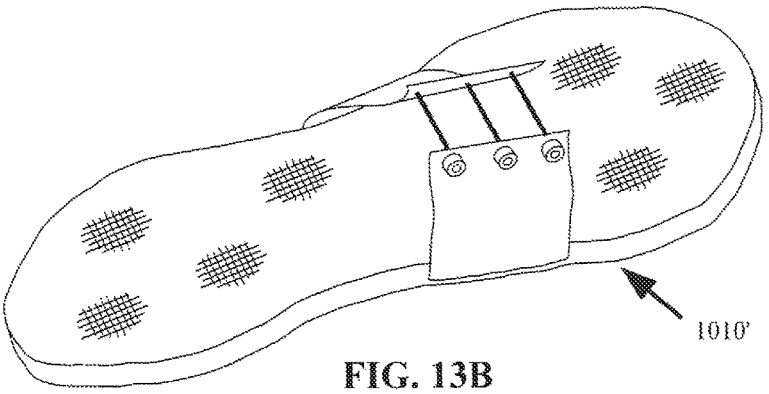
FIG. 13B is a perspective view of the flip flop of FIG. 13A, but shown without the cross-member connecting the three lateral tube members that connect the split toe strap.

FIG. 13 is a perspective view of a customized flip flop embodiment 1010C, which may be a customized version of the flip flop 1010 shown in FIG. 13A. Flip flop 1010 may have a split toe strap, with a first toe strap portion 1060L being attached proximate to a first side of the sole 1020, and a second toe strap portion 1069R being attached proximate to a second side of the sole. The free ends of the toe straps 1060L and 1060R may be secured with respect to each other by a plurality of tube members (e.g., 1030A, 1030B, 1030C, etc.) that may extend between eyelets in the straps, each of which may have a threaded element 1040 releasably secured on its ends. The tube members may be customized with rubber bands, as seen in FIG. 13, through removal of the threaded element on one of the ends thereof. A cross-member 1030Z may be connected to one or more of the tube members (e.g., connected to 1030A, 1030B, 1030C, etc.), as seen in FIG. 13A, and which may also be customized using rubber hands. FIG. 13B shows a variation of the flip flop 1010, in which the flip flop 1010' does not utilize the cross member. It should be noted that any feature of any flip flop or sandal described herein may be utilized in combination with the features of any another embodiment, so although it is not shown therein, the tube members of flip flop 1010 of 1010' may be customized using the rotatable foam rubber wheels discussed hereinabove, or both the foam rubber wheels and the rubber bands. The top surface 1020T of the sole 1020 may be formed with a coarse surface similar to fine sand paper, which may serve as an anti-slip surface for the foot of the wearer, and which may also, depending upon the grit size (coarseness) utilized, may serve to reduce calluses on the person's feet. Different versions of the sandal 1120 may be provided with varying different grit sizes for the top surface 1020T of the sole 1020, just as it may be provided according to different foot sizes.

FIG. 14 is a perspective view of a customized flip flop embodiment 1110C, which may be a customized version of the flip flop 1110 shown in FIG. 14A, which may be formed by the parts shown in the exploded view of FIG. 14B. Flip flop 1110 may have an elongated thong 1130 connected to dual, rear leaning toe straps 1160A and 1160B, and also being connected to dual forward leaning toe straps 1170A and 1170B, each of which may be customized with rubber bands of assorted colors and sizes. The bottom of the thong 1130, the bottom of the rear leaning straps 1160A/1160B, and the bottom of the forward leaning straps 1170A/1170B may each be secured to a respective mounting member (1130M, 1160Mi/1160Mii, 1170Mi/1170Mii), each of which may be formed into a rectangular shape, which may have a transverse hole formed therein. Each of the mounting members (1130M, 1160M, 1170M) may be releasably secured within a correspondingly shaped recess (1123, 1126*i*/1126*ii*, 1127*i*/1271*ii*) in the sole 1120 using pins 1140, as seen in FIG. 14B. Hole may be formed in the sides of the sole 1120, which may align with the transverse holes formed in the block members. The pins 1140 may be inserted into the holes in the sides of the sole 1120, and may be of sufficient length to furthermore be inserted into the transverse hole in the block member, when positioned in the recess, and through to the hole on the opposite side of the recess as well. The pins 1140 may be retained therein using only a friction fit. Alternatively, or additionally, adhesive may be used to retain the pins 1140 within the respective holes in the sole and/or the transverse holes in the block members.

FIG. 15 is a perspective view of a flip flop embodiment 1210, which is shown in the top, side, and end views of FIGS. 15A, 15B, and 15C. The flip flop 1210 may have tube members configured to form a thong and foot-retaining straps, which may also support a decorative ornament 1299 thereon. The flip flop 1210 is shown in FIGS. 15D-15E without the decorative item 1299, in which it may be seen to have a first strap 1260, a second strap 1270, and a third strap 1280. Each of the ends of strap 1260 may be threaded, and which may thereby be secured to the sole 1220 using a threaded mechanical fastener 1230 that may be received within a recess in the bottom of the sole, as seen in FIG. 15C. This may serve to retain the strap 1260 upon the wearer's foot. To prevent the threaded mechanical fastener 1230 from dropping down out of the recess and dragging the strap 1260 downward with it, the strap may have a head 1260H fixedly secured at an appropriate location thereon. The other straps (1270 and 1280) may generally be similarly constructed. However, the rear end of strap 1280 may be fixedly secured to the side of the sole 1220, as shown.

Figure 16:
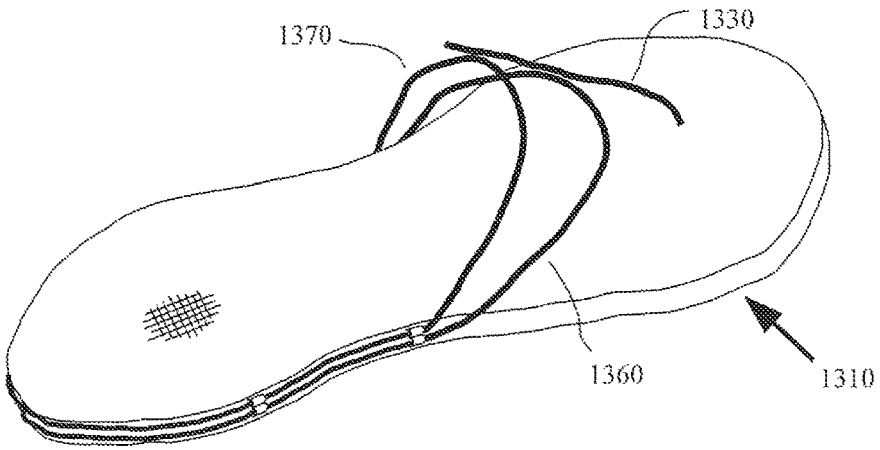
FIG. 16 is a perspective view of another embodiment of a flip flop taught herein, which has an elongated thong that is connected to a first forward leaning toe strap, and a second forward leaning toe strap.

FIG. 16 is a perspective view of flip flop embodiment 1310, which may have a tube member configured to form an elongated thong 1330, which may be connected to a first forward leaning tubular toe strap 1360, and to a second forward leaning toe strap 1370. The toe straps 1360 and 1370 may each extend to, and be secured to, the side of the sole 1320, and may thereafter encircle the periphery of the sole, from one side to the other side, as seen in FIG. 16.

Figure 17:
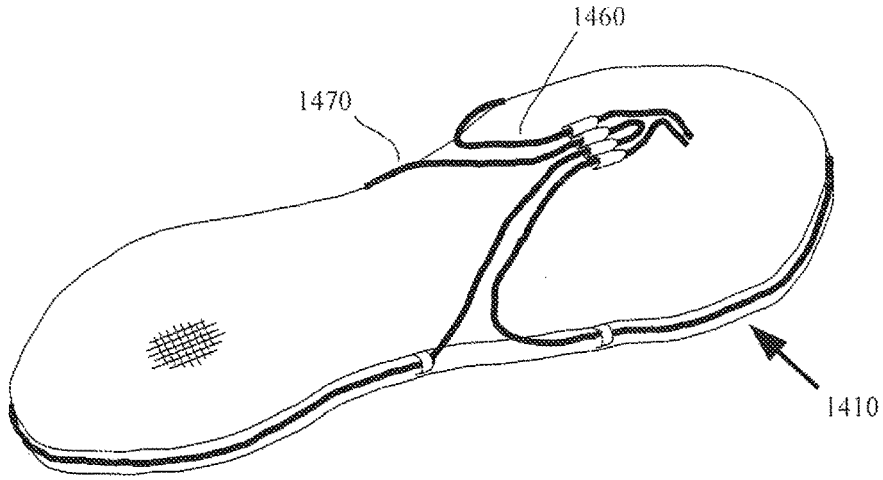
FIG. 17 is a perspective view of another embodiment of a flip flop taught herein, which has a first tube member that extends along the side periphery of the rear of the sole and across the front part of the flip flop to form part of a toe strap, and a second tube member that extends along the side periphery of the front of the sole and across the front part of the flip flop to form another portion of a toe strap and a thong.

FIG. 17 is a perspective view of a flip flop embodiment 1410, which may have a first tube member 1460 that may extend along the side periphery of the rear of the sole 1420 and across the front part of the flip flop to form part of a toe strap, and a second tube member 1470 that may extend along the side periphery of the front of the sole and across the front part of the flip flop to form another portion of a shoe retaining strap, and a thong.

Figure 18A:
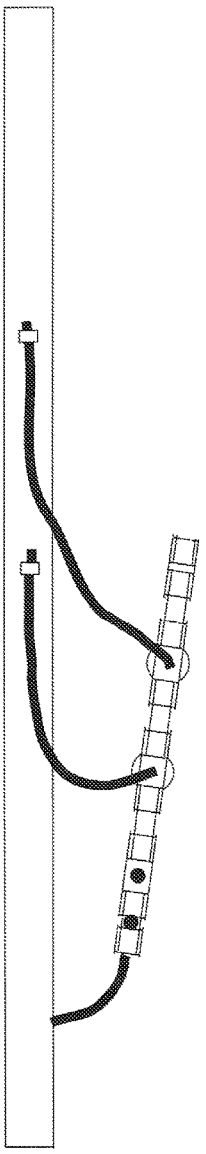
FIG. 18A is a side view of the flip flop embodiment of FIG. 18.
Figure 18:
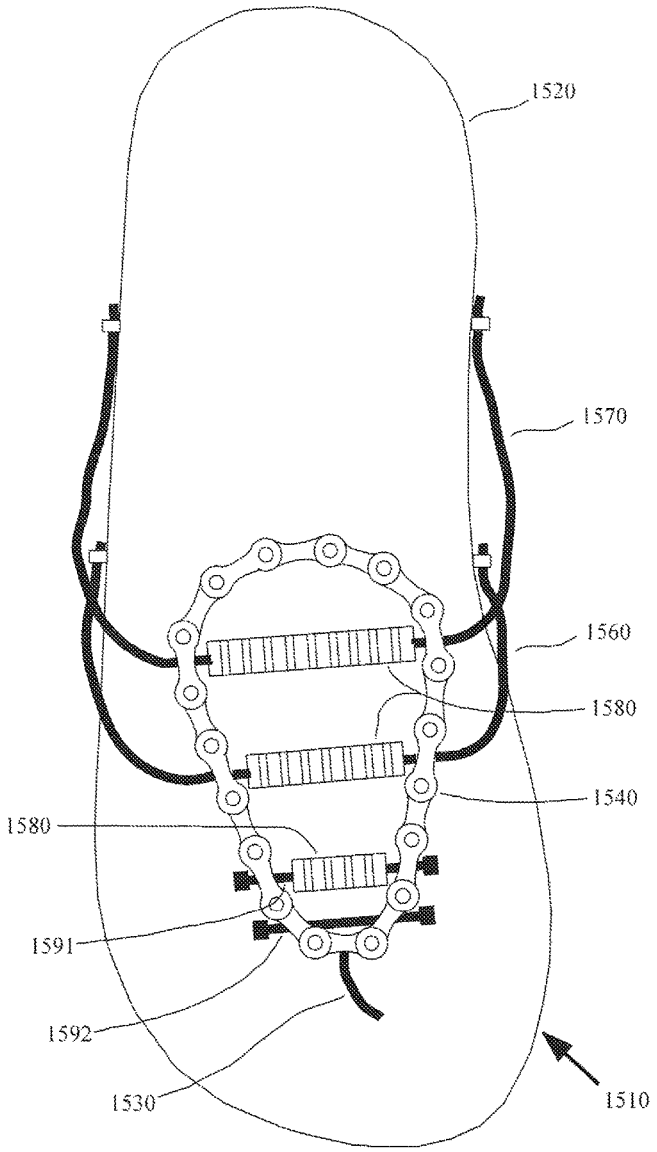
FIG. 18 is a perspective view of another embodiment of a flip flop taught herein, which has a first forward leaning toe strap, and a second forward leaning toe strap, each of which passes through a pear-shaped upper member that is formed to resemble a bicycle chain, with the front of the pear-shaped bicycle chain member supported at its front end by a thong member.

FIG. 18 is a perspective view of a flip flop 1510, which may have a first forward leaning toe strap 1560, and a second forward leaning toe strap 1570. The rear end of each of the toe straps 1560 and 1570 may each be secured to the side of the sole 1520, while the forward portion of each toe strap may pass through and support an upper member 1540 that may be formed to resemble a bicycle chain that has been arranged into a pear shape. The front of the pear-shaped chain member 1540 may be supported by a thong member 1330 that may protrude up from the sole 1520. Each of the toe straps 1560 and 1570 may have foam rubber wheels rotatably received thereon, at a position in between the pear-shaped chain member 1540. Additional tube members 1590 and 1591 may also be transversely received through side openings in the pear-shaped chain member 1540, and the ends of the tube members may be capped to prevent them from becoming dislodged therefrom. Either or both of the tube members 1590 and 1591 may have foam rubber wheels received thereon.

Figure 19:
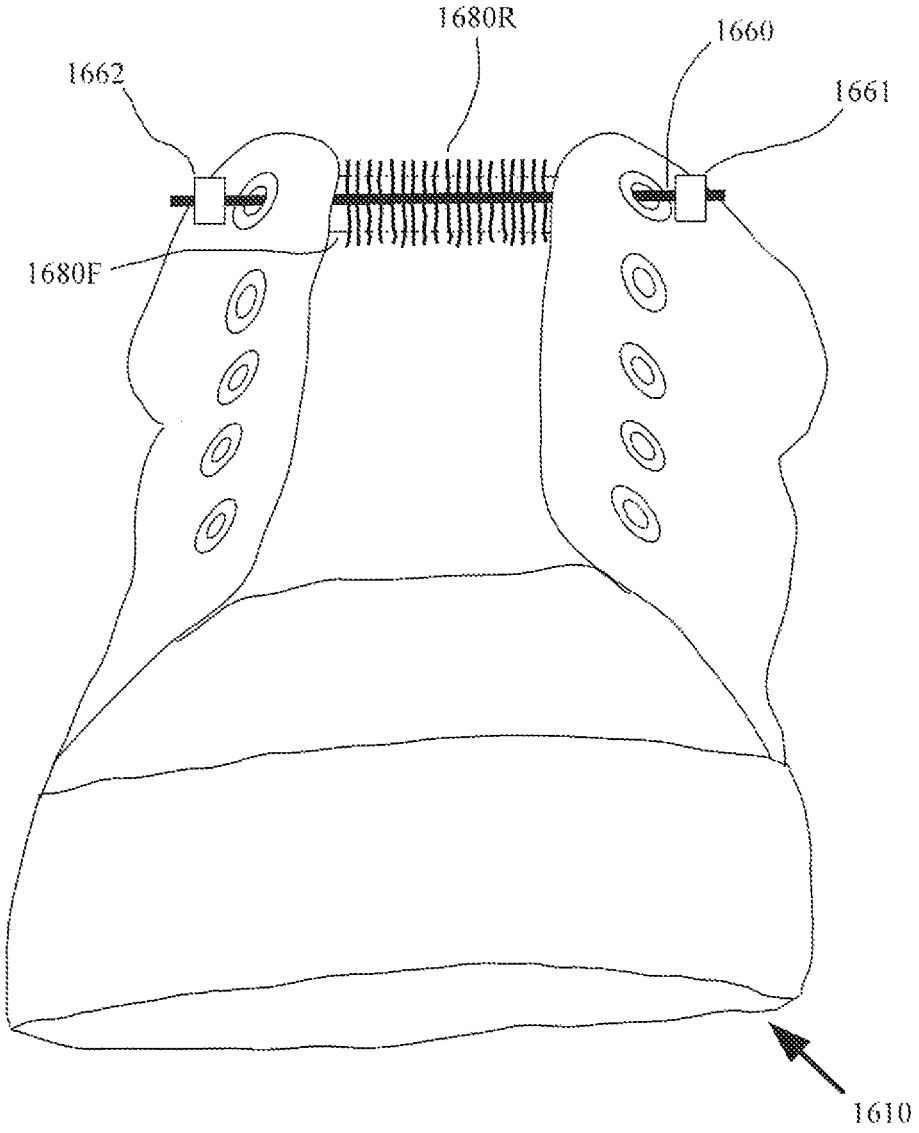
FIG. 19 is a front view of another embodiment of footwear taught herein, being in the form of a sneaker without laces, but which has a single cylindrical member spanning between the two uppermost eyelets, and with a plurality of rubber of assorted colors received thereon.

FIG. 19 is a front view of a footwear embodiment 1610 taught herein, being in the form of a sneaker without laces, but which has a cylindrical member 1660 that may span between the two uppermost eyelets. A plurality of foam rubber wheels 1680F of assorted colors may be received thereon. Each of the ends of the cylindrical member 1660 may have a cap 1661/1662 threaded thereon, and which may permit replacement of the foam rubber wheels, and may also permit placing of colored rubber bands 1680R over the rubber wheels for a different appearance.

Figure 20:
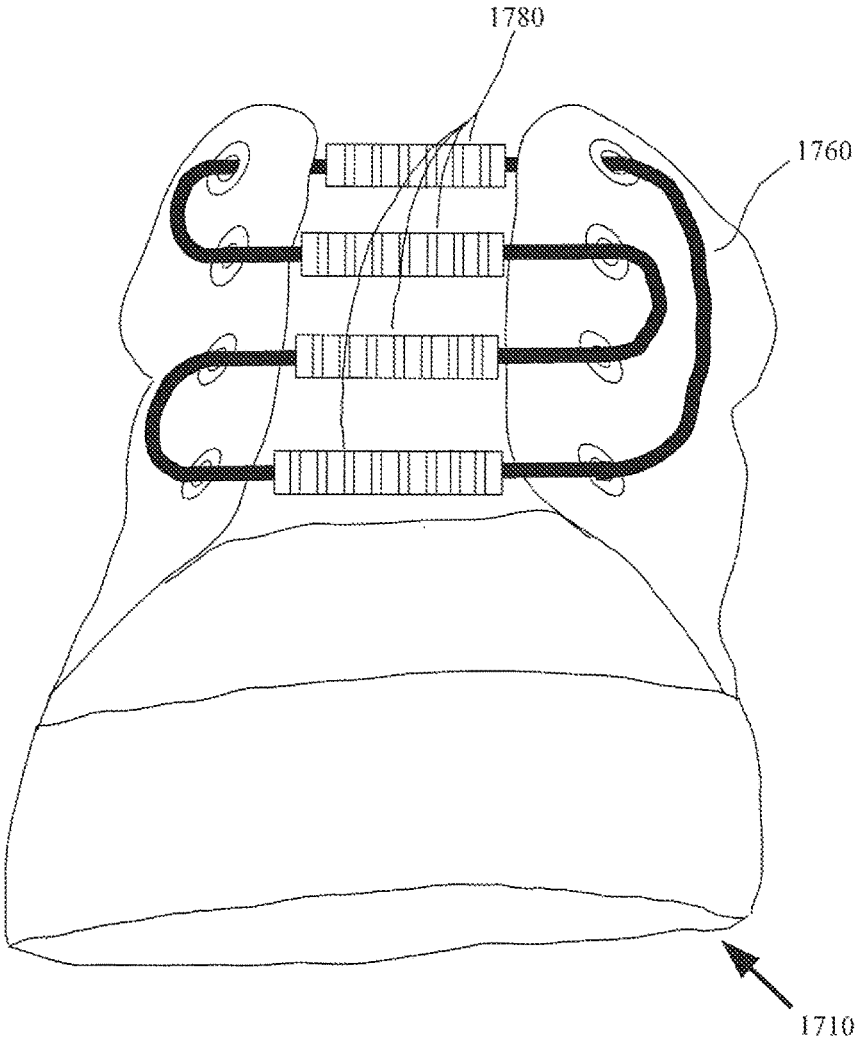
FIG. 20 is a perspective view of the sneaker of FIG. 19, but where the cylindrical member has been replaced by a tube-member that passes through each of the eyelets, and which supports foam rubber wheels between the quarters on each side of the sneaker.

FIG. 20 is a perspective view of a sneaker embodiment 1710, which may have the laces removed and replaced by a tube-member 1760 that may pass through each of the eyelets, and which may support foam rubber wheels 1780 between the quarters on each side of the sneaker.

Figure 21:
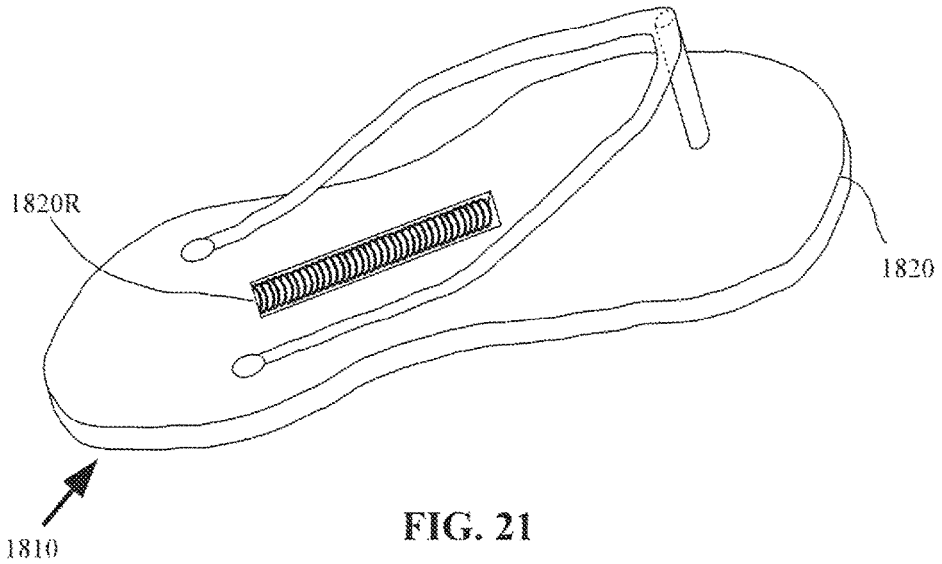
FIG. 21 is a perspective view of another embodiment of a flip flop taught herein, which has an elongated recess formed in the top of the sole, into which may be received an insert that is filled with assorted colors of rubber bands or other colored objects.
Figure 21A:
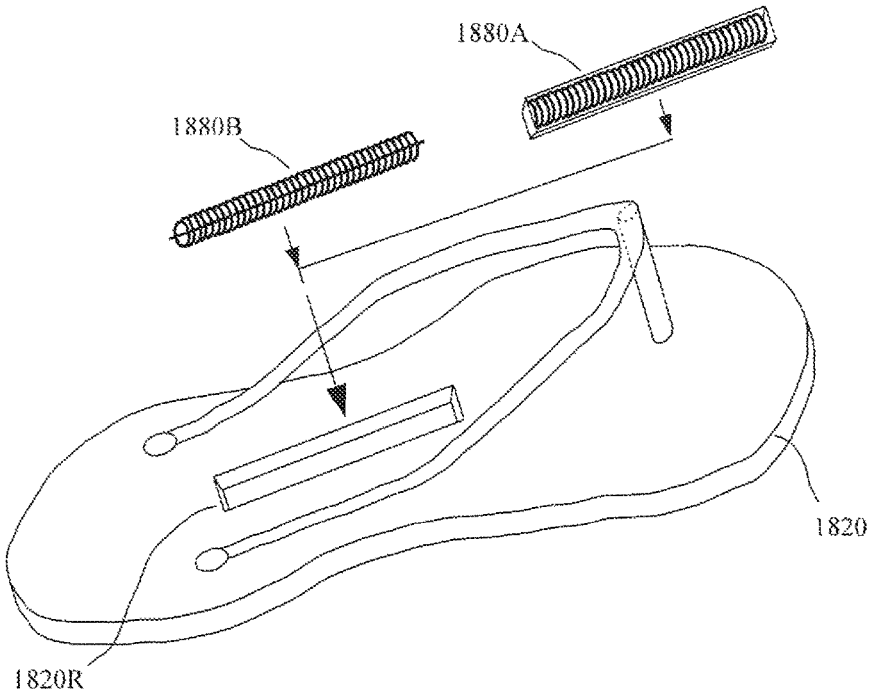
FIG. 21A is an exploded view of the flip flop embodiment of FIG. 21, showing two embodiments of insert that may be received into the recess in the flip flop.

FIG. 21 is a perspective view of a flip flop embodiment 1810, which may have an elongated recess 1820R formed in the top of the sole 1820, into which may be releasably received an insert 1880A (or 1880B). The insert 1880A may include a cylindrical member upon which rubber bands of assorted colors may be positioned. The ends of the insert 1880A may be releasably received in corresponding openings in the sole 1820, and may be supported thereat by a flexible clamp member. Alternatively, insert 1880B may include having the cylindrical member with rubber bands positioned within a clear plastic casing, as seen in FIG. 21A, which may be fixedly or releasably secured within the recess 1820R in the sole 1820, using any suitable means known in the art (e.g., adhesive, or a clamp member).

Figure 22:
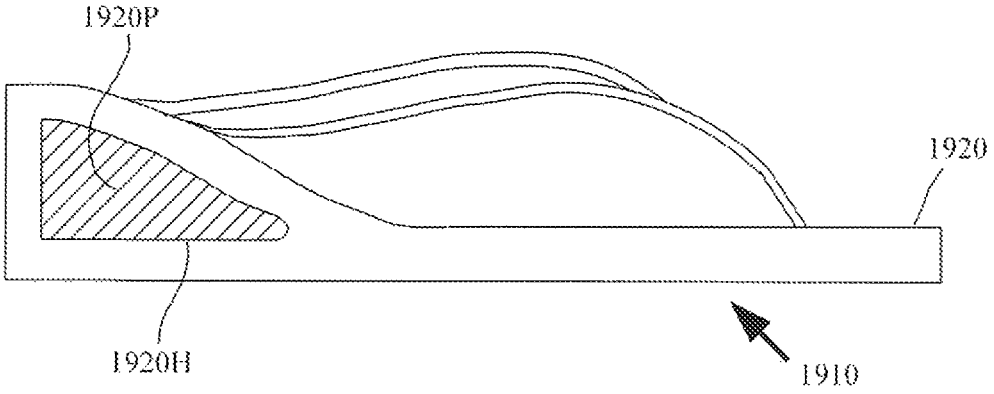
FIG. 22 is a side view of a flip flop embodiment taught herein, having a sole the transitions into a hollow wedge-shaped heel with clear plastic enclosing its sides, and with the hollow area being filled with rubber bands, or with glitter, rhinestones, shells, potpourri, flowers, lights, etc.

FIG. 22 is a side view of a flip flop embodiment 1910, in which the sole 1920 may transition into a hollow wedge-shaped heel 1920H, that may be open at both sides and may be covered with clear plastic 1920P enclosing the hollow area. The hollow area may be filled with rubber bands, or glitter, rhinestones, shells, potpourri, flowers, lights, etc., or a combination of any of the above.

FIG. 23 is a perspective view of a flip flop 2010, which may have a plurality of straps configured to go over the top of the wearer's foot, and which may be uniquely supported by the sole 2020, as seen in the top, side, and end views of FIGS. 23A, 23B, and 23C. The flip flop 2010 may have a first strap 2040 that may extend laterally from one side of the sole 2020 to the other side, directly across the top of the wearer's foot, each end of which may be attached to the side of the sole. A thong strap 2030 may have a first end be secured to the lateral strap 2040, and a second end may pass down through an opening in the sole, then have a portion 2030P run forwardly within a recess in the bottom of the sole (FIG. 23C), and then turn upwardly to be fixedly secured within the center of a disk member 2035. The disk member 2035 may be received in a corresponding disk shaped opening in the top of the sole, and may be fixedly secured therein. If the disk member 2035 is not fixedly secured within the recess in the top of the sole, it may be free to extend upwardly a small amount, based upon the amount of slack in the strap 2030. A left-side strap 2060 and a right side strap 2070 may each be similarly secured to the front of the sole 2020 (i.e., using disk members 2065 and 2075), and may be fixedly secured to the lateral strap 2040, but each may also extend further rearward, and may pass through and loop under the bottom of the sole, and may then protrude up through another portion of the sole to form an ankle strap portion 2050.

Figure 24:
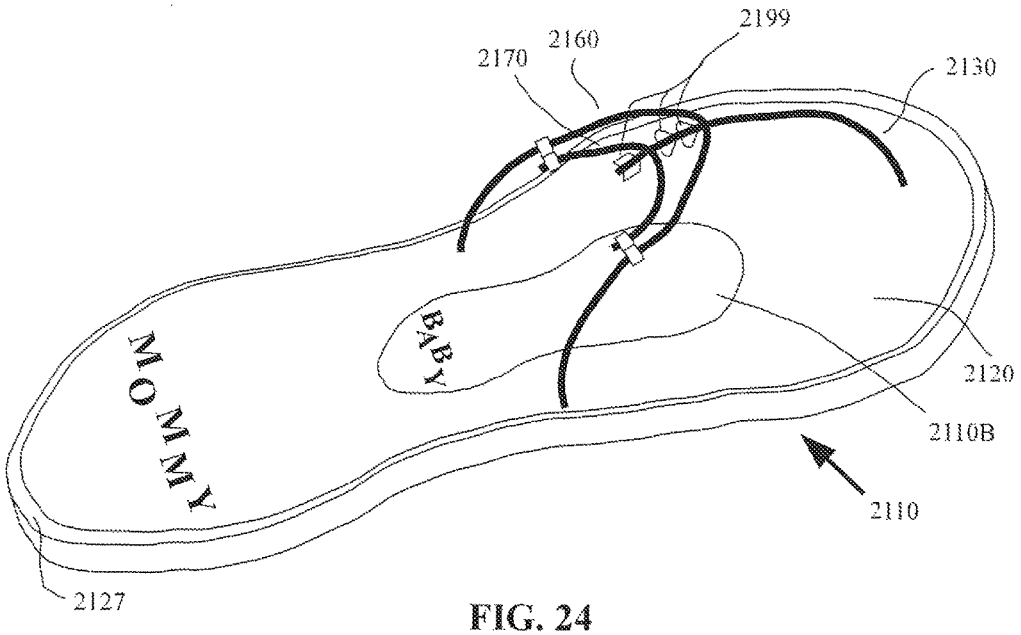
FIG. 24 is a perspective view of another flip flop embodiment taught herein, which may have a thong connected to a pair of straps configured to go over the top of the foot, and an inset sole sized for a baby of young child.

FIG. 24 is a perspective view of a flip flop 2110, which may include a forward leaning tubular toe strap 2160, both ends of which may be fixedly secured to the sole 2120. Another tube member may be used to form an elongated thong strap 2130, which may have a portion be connected to the forward toe strap 2160. A secondary top strap 2170 may be formed to have an arcuate shape, each end of which may be fixedly secured to a portion of the forward leaning tubular toe strap 2160. The thong strap 2130 may be fixedly secured to the center of the secondary top strap 2170 and may extend slightly beyond such securement. One or more ornaments 2199 may be mounted upon the thong strap 2130 between the toe straps 2160 and 2170, and may also be mounted on the overhanging portion of the thong strap 2130 that extends beyond toe strap 2170. The sole 2120 may also have an inset sole 2120B formed to match the size of a baby's or a young child's foot, which may be labeled "baby," and which may be a different color than the sole 2120. The rear portion of the sole 2120 may also be labeled as "mommy." A colored strip 2127, which may be colored to match the color used for the inset sole 2120B, may be secured about the periphery of the sole 2120.

Figure 25:
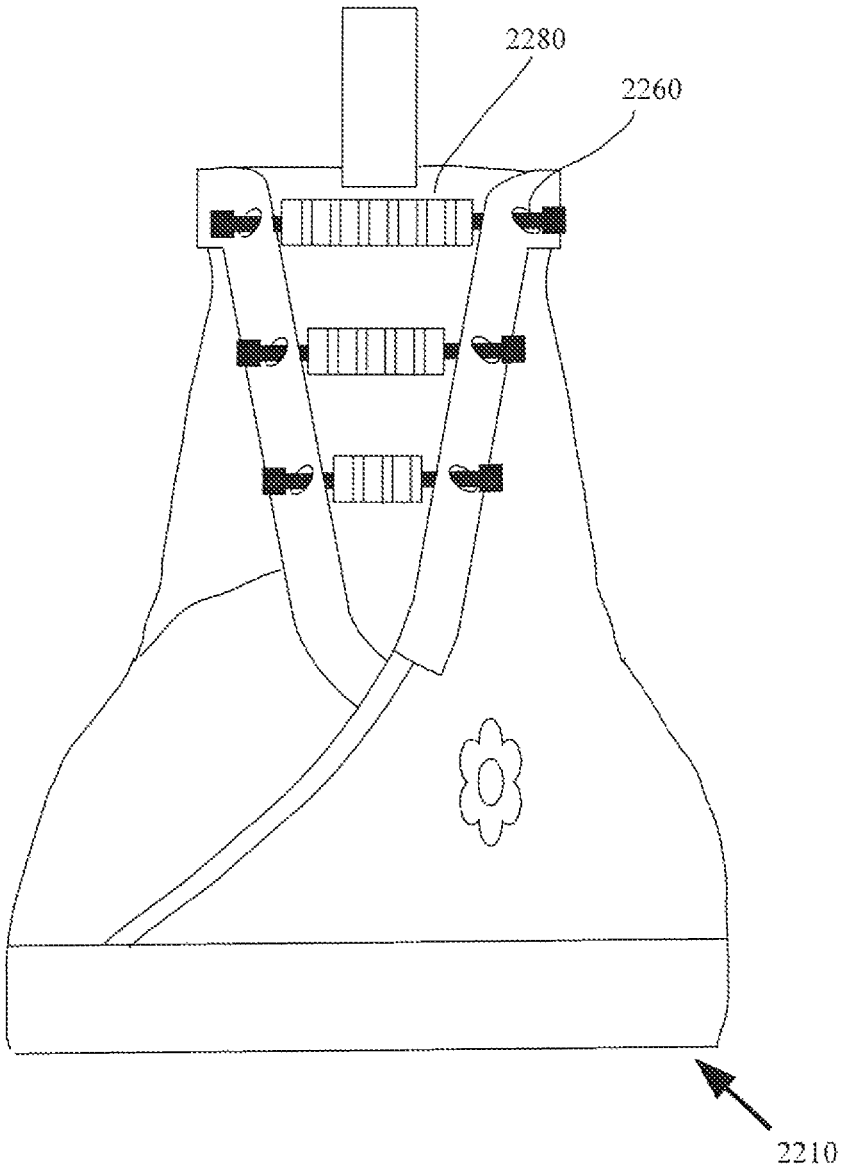
FIG. 25 is a front view of a driving shoe configured to permit easy entry into the footwear using foam rubber wheels that may rotate on a rod member secured between the upper-most eyelets, and which may be further configured to permit rolling of the rear of the shoe using wheels rotatably attached thereat.
Figure 26:
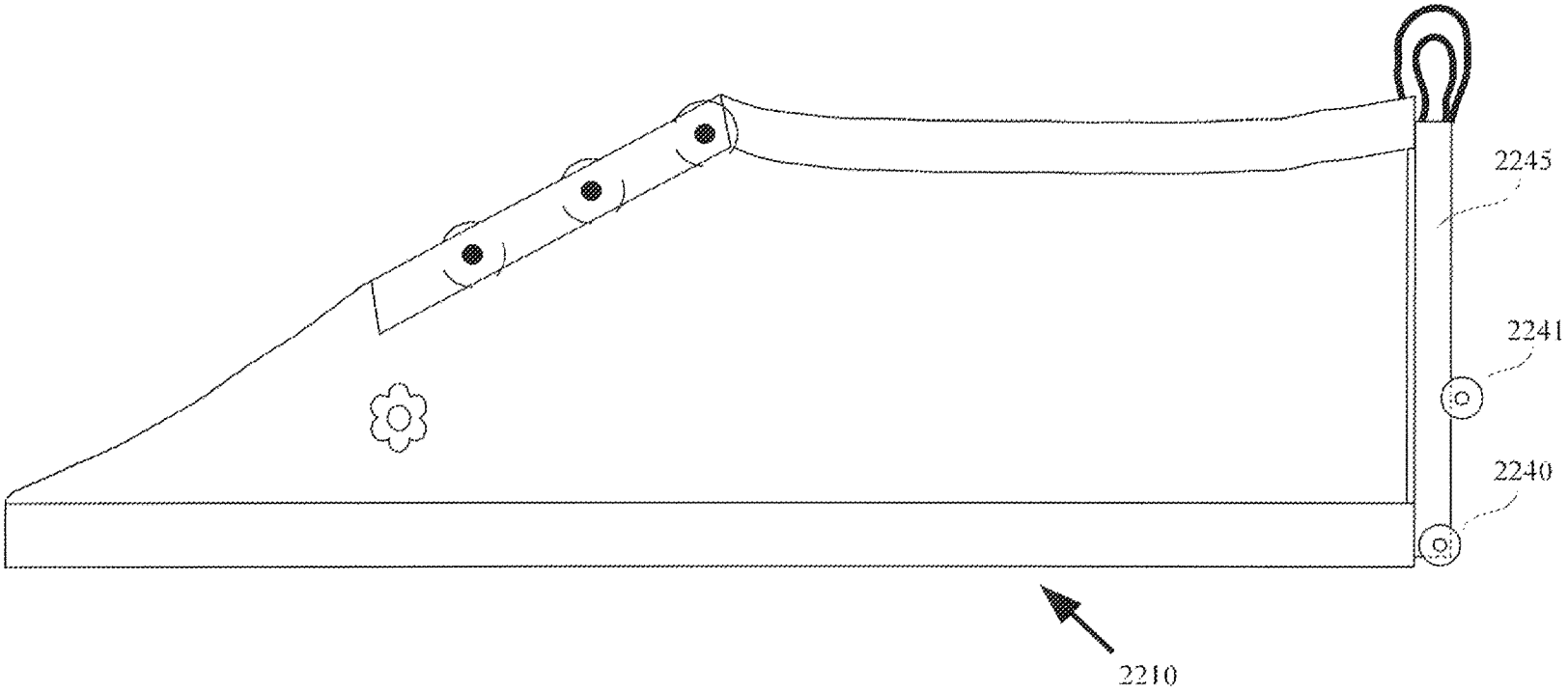
FIG. 26 is a side view of the driving shoe of FIG. 25.

FIG. 25 is front view of a driving shoe 2210. The front portion of the shoe 2210 may be configured to permit easy entry into the footwear using foam rubber wheels 2280 that may rotate on a first rod member 2260 that may be secured between the upper-most eyelets. The shoe 2210 may be further configured to permit rolling of the rear of the shoe using plastic wheels 2240 (FIG. 26) that may be rotatably attached thereat to either side of a post 2245. Other wheels 2245 may be rotatably secured to an upper location of the post 2245.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the attached claims and their equivalents.

What is claimed is:

1. A customized flip flop comprising:

a sole:

a strap member, said strap member comprising:

a thong portion; and a first strap portion and a second strap portion, each said first and second strap portions configured to transition from said thong portion at a first end, and to terminate at a respective distal end;

a first cylindrical stop member at each said distal end of said first and second strap portions, and said thong portion;

a protrusion configured to extend from each said first cylindrical stop member to a distal end;

a second cylindrical stop member at each said distal end of each said protrusion;

a plurality of ring-shaped rubber bands slidably received over said first and second cylindrical stop members and onto said first strap portion;

a plurality of ring-shaped rubber bands received over said first and second stop members and onto said second strap portion; and wherein said stop members of each said strap portions and said thong portion are secured to said sole.

2. The customized flip flop according to claim 1 wherein each of said first and second strap portions comprise a plurality of transverse recesses formed about an entire periphery of said strap portion; and wherein each of said plurality of rubber bands are configured to fit within one of said recesses.

3. The customized flip flop according to claim 1 wherein each of said plurality of rubber bands comprise rubber bands of various different colors.

4. The customized flip flop according to claim 3 wherein each of said plurality of rubber bands is formed of a material configured to absorb photons when present, and to thereafter glow said various different respective colors when in the dark.

5. The customized flip flop according to claim 4 wherein each of said first and second strap portions is formed of a material configured to absorb photons when present, and to thereafter glow said various different respective colors when in the dark.

6. The customized flip flop according to claim 5 wherein a portion of said sole is formed of a material configured to absorb photons when present, and to thereafter glow said various different respective colors when in the dark.

7. The customized flip flop according to claim 1 wherein each of said plurality of rubber bands comprise rubber bands of various different colors and thicknesses.

8. The customized flip flop according to claim 1 wherein each of said plurality of rubber bands comprise rubber bands of various different colors, thicknesses, and outer diameters.

9. The customized flip flop according to claim 1 wherein each of said plurality of ring-shaped rubber bands is slidably received over said first and second cylindrical stop members of said respective strap portions using a conically shaped tool configured to couple to at least said second cylindrical stop member.

* * * * *